US007234239B2

(12) United States Patent
Saito et al.

(10) Patent No.: US 7,234,239 B2
(45) Date of Patent: Jun. 26, 2007

(54) HAIR REMOVING DEVICE WITH A LOTION APPLICATOR

(75) Inventors: Atsuhiro Saito, Hikone (JP); Hirokazu Kato, Hikone (JP); Jyuzaemon Iwasaki, Nagahama (JP); Hideki Tanaka, Hikone (JP); Koutarou Yanagi, Hikone (JP); Yasunori Ueda, Hikone (JP); Toshiyuki Tsushio, Hikone (JP); Masanobu Yamasaki, Hikone (JP); Youji Urano, Ikeda (JP); Harunori Kitahara, Hirakata (JP)

(73) Assignee: Matsushita Electric Works, Ltd. (JP)

( * ) Notice: Subject to any disclaimer, the term of this patent is extended or adjusted under 35 U.S.C. 154(b) by 222 days.

(21) Appl. No.: 10/504,166

(22) PCT Filed: Feb. 12, 2003

(86) PCT No.: PCT/JP03/01427

§ 371 (c)(1),
(2), (4) Date: Aug. 11, 2004

(87) PCT Pub. No.: WO03/068466

PCT Pub. Date: Aug. 21, 2003

(65) Prior Publication Data

US 2005/0131427 A1 Jun. 16, 2005

(30) Foreign Application Priority Data

| | | | |
|---|---|---|---|
| Feb. 13, 2002 | (JP) | ..... | 2002-035898 |
| Feb. 13, 2002 | (JP) | ..... | 2002-035899 |
| Mar. 29, 2002 | (JP) | ..... | 2002-097444 |
| Sep. 25, 2002 | (JP) | ..... | 2002-280012 |

(51) Int. Cl.
*B26B 19/40* (2006.01)

(52) U.S. Cl. ..... 30/41; 606/133

(58) Field of Classification Search ..... 30/41; 606/131–133; 417/472, 571, 572
See application file for complete search history.

(56) References Cited

U.S. PATENT DOCUMENTS 3,176,392 A 4/1965 Gwinn (Continued)

FOREIGN PATENT DOCUMENTS

DE 3134919 * 3/1983

(Continued)

OTHER PUBLICATIONS

International Search Report for PCT/JP03/01427 mailed on May 19, 2003.

*Primary Examiner*—Stephen Choi
(74) *Attorney, Agent, or Firm*—Rader, Fishman & Grauer PLLC

(57) ABSTRACT

A hair removing device with a lotion applicator includes a housing, a hair removing head mounted to the housing and adapted to be held against a user's skin for hair depilation or hair epilation, an applicator which dispenses a lotion on the user's skin, a tank holding the lotion and a lotion supply mechanism for supplying the lotion from the tank to the applicator. The lotion supply mechanism includes a regulating device, which regulates an amount of the lotion being dispensed from the applicator. The lotion supply mechanism includes a powered pump for expelling the lotion from the tank to the applicator. The regulating device includes a handle for varying pump capacity of the powered pump. The applicator is incorporated into a head frame forming a part of the hair removing head with the head frame being detachable from the housing.

4 Claims, 34 Drawing Sheets

U.S. PATENT DOCUMENTS

| | | | | |
|---|---|---|---|---|
| 3,846,326 | A | 11/1974 | Wright et al. | |
| 4,635,361 | A | 1/1987 | DeMars | |
| 5,168,628 | A * | 12/1992 | Mock et al. | 30/41 |
| 5,993,180 | A * | 11/1999 | Westerhof et al. | 417/571 |
| 6,131,288 | A * | 10/2000 | Westerhof et al. | 30/41 |
| 6,312,436 | B1 | 11/2001 | Rijken et al. | |
| 6,493,940 | B2 * | 12/2002 | Westerhof et al. | 30/41 |
| 6,594,905 | B2 * | 7/2003 | Furst et al. | 30/41 |
| 2002/0004986 | A1 | 1/2002 | Furst et al. | |

FOREIGN PATENT DOCUMENTS

| | | | |
|---|---|---|---|
| JP | 59-108574 | U1 | 7/1984 |
| WO | WO-98/08661 | A1 | 3/1998 |

* cited by examiner

HAIR REMOVING DEVICE WITH A LOTION APPLICATOR

TECHNICAL FIELD

The present invention is directed to a hair removing device with a lotion applicator, and more particularly to the personal hair removing device capable of dispensing a lotion for facilitating the hair treatment as well as for making a skin care.

BACKGROUND ART

WO98/08661 and Japanese Utility Model Publication No. 59-108574 disclose a portable hair removing device capable of dispensing a lotion for facilitating the hair removal. The device incorporates a pump which is activated by a button or switch to feed the lotion over a user's skin where the hair removal is intended. The device is designed to dispense the lotion at a constant rate, which poses a problem that the lotion may be too much or too less for users of different skin characteristics or preferences.

DISCLOSURE OF THE INVENTION

In view of the above inconvenience, the present invention has been achieved to provide an improved hair removing device which is capable of controlling a dispensing amount of the lotion to give the lotion adequately as intended by a user for comfortable hair treatment. The device in accordance with the present invention includes a housing carrying a hair removing head which is adapted to be held against a user's skin for hair depilation or epilation. The device also includes an applicator which dispenses the lotion on the user's skin, a tank holding the lotion, and a lotion supply mechanism for supplying the lotion from the tank to the applicator. The lotion supply mechanism includes a regulating means which regulates an amount of the lotion being dispensed from the applicator.

Thus, the applicator is enabled to dispense the lotion in an adequate amount as preferred by the user, thereby assuring comfortable hair removing treatment.

The lotion supply mechanism includes a feed path extending from the tank to the applicator. In a preferred embodiment of the present invention, the regulator means includes a manipulator which acts on the feed path to vary the cross-sectional area of the feed path for regulating a flow rate of the lotion, i.e., the dispensing amount of the lotion.

The tank may be made of a flexible material as a collapsible bag, and the lotion supply mechanism includes a pressure means which applies a pressure to the tank for expelling the lotion out of the tank to the applicator. In this case, the regulator means may include a handle for varying the pressure applied to the tank by the pressure means. When the pressure means is designed to include more than one pressurizers, the handle is interlocked with one of the pressurizers for varying the overall pressure being applied to the tank for regulation of the dispensing amount of the lotion.

Instead of the pressure means, the device may utilize a powered pump for expelling the lotion from the tank to the applicator. In this instance, the regulating means also include a handle for varying pump capacity of the powered pump.

A diaphragm pump may be utilized as the powered pump which includes a pump chamber with a diaphragm carrying a piezoelectric element. The diaphragm is caused to deform, in response to a voltage being applied to the piezoelectric element, to develop a force of expelling the lotion out of the tank. In this instance, the regulating means includes the handle that varies the frequency at which the diaphragm repeats deforming for regulating the flow rate of the lotion being expelled to the applicator.

Instead of the powered pump, the lotion supply mechanism may include a manual pump having a pump chamber and a movable member which develops a force of expelling the lotion upon being displacement. The handle of the regulator is connected to the movable member for varying a displacement amount that the movable member is allowed to move, thereby enabling to regulate the dispensing amount of the lotion equally.

The regulating means may be additionally provided with a stop means which stops feeding the lotion from the tank to the applicator, thereby assuring another possibility of making the hair removal without the aid of the lotion.

The present invention discloses another advantageous feature of avoiding undesired leakage of the lotion from the tank when the applicator is removed together with a head frame of the hair removing head for the purpose of cleaning the hair removing unit. For this purpose, the lotion supply mechanism includes a head conduit extending integrally from the applicator and a tank conduit extending from the tank. The tank conduit is detachably connected to the head conduit for feeding the lotion from the tank to the applicator, while the head conduit is detachable together with the head frame from the housing. The lotion supply mechanism includes a stop means which, in response to the detachment of the head frame from the housing, stops feeding the lotion out the tank conduit.

The stop means may be realized by a check valve which is provided at one end of the tank conduit for closing the same. The check valve is actuated by the head conduit to open when the head conduit is moved to be connected to the tank conduit.

Alternatively, the stop means may be realized by a lock member which is positioned at one end of the tank conduit and is biased into a lock position of closing the tank conduit. The lock member is interlocked with the head frame so that it is actuated by the head frame to move into an unlock position of opening the tank conduit as long as the head frame is kept attached to the housing.

When the powered pump is utilized for expelling the lotion from the tank to the applicator, the stop means may be in the form of a stop switch which is actuated, upon detachment of the head frame from the housing, to cease operating the pump.

Preferably, the head conduit is connected to the tank conduit outside of the hair removing unit so as to make the connection free from taking in clipped hairs which would otherwise clog the lotion feed path.

Also for avoiding undesired entry of the clipped hairs, the head conduit extends downward from the hair removing head and is formed at its lower end with a socket for receiving the upper end of the tank conduit to make an interconnection therebetween. That is, as the socket of larger diameter than that of the upper end of the tank conduit is directed with its opening facing downward, the socket does not act to collect the clipped hairs in its large opening to thereby reduce a possibility of capturing the clipped hairs.

The tank conduit may be formed with a tank connection with the tank. The tank connection is pivotally supported to the housing so as to be movable within a predetermined angular angle in relation to a nearby plane of the housing for selectively projecting outwardly of the housing. With this feature, the tank can be coupled to the tank conduit in a direction suitably angled with regard to the plane of the housing for facilitating the replacement of the tank.

It should be noted here that the above technical feature of avoiding the undesired lotion leakage from the tank conduit can alone constitute an independent subject matter of the invention without relying upon the feature of regulating the dispensing amount of the lotion.

Further, the present invention discloses a unique feature of avoiding the leakage of the lotion from the tank itself prior to the tank being coupled to the tank conduit or the lotion feed path. For this purpose, the tank has a spout which is detachable to the lotion feed path and provided with a normally closed elastic valve. The elastic valve is caused to deform elastically to open for discharging the lotion to the lotion feed path only when the spout is coupled to the lotion feed path.

The elastic valve has a thick member and a thin member surrounding the thick member and giving elasticity to the valve. The thin member is supported to the spout and is provided with a vent for passing therethrough the lotion. The spout includes a socket hole of circular cross-section for detachably receiving therein a tube forming the lotion feed path. The thick member is formed into a semi-spherical shape with a rounded portion being pressed against the end of the socket hole to close the same in the absence of the tube in the socket hole. Thus, the rounded portion of the semi-spherical shaped thick member is utilized to close the spout successfully for preventing the lotion leakage.

Preferably, the tank is formed into a flat flexible bag having a reduced thickness relative to its width. In this connection, the spout is formed with restricting means adjacent to the elastic valve in order to restrict an external force being applied in the thickness direction of the bag from transmitting to and deforming the thick member. Thus, the elastic valve can be free from being caused to open even if the user pinches the bags around the elastic valve The restricting means may comprise a pair of projections which are diametrically opposed around the end of the socket hole in alignment with the thickness direction of the bag. The projections are held in an intimate supporting contact with the thin member so as to keep the thin member free from being deformed by the external force applied to the bag in the thickness direction.

Further, the thick member is preferably formed with a seat projection on the rounded top of the semi-spherical shaped thick member for receiving the end of the tube inserted into the socket hole. The seat projection is dimensioned to leave a gap of a gap of 0.2 mm to 3 mm between the rounded portion and the end of the tube for allowing the lotion to pass therethrough when the tube is inserted into the socket hole to push said thick member. With the use of the seat projection for abutment against the tube, the rounded portion responsible for closing the socket hole can be kept intact for assuring reliable closure of the spout.

It should be noted at this point that the above feature of preventing the lotion leakage from the tank itself can alone constitutes another subject matter without relying upon the previously-mentioned features of regulating the dispensing amount of the lotion or the features of preventing the lotion leakage upon detachment of the head frame from the housing.

Preferably, the elastic valve is made of a rubber material selected at least one from the group consisting of ethylene-propylene rubber, nitrile-butadiene rubber, and fluorinated rubber.

Further, the present invention gives another useful feature of providing an indicator for indicating the amount of the lotion remaining in the tank. When the lotion supply mechanism utilizes a pressurizer plate that moves relative to the housing in order to give a pressure to the tank for expelling the lotion to the applicator, a sensor is provided to monitor the position of the pressurizer plate to give a corresponding signal representative of the amount of the lotion remaining in the tank. In response to the signal, the indicator gives a visual indication of the remaining amount of the lotion.

Instead of using the sensor, the tank itself may be formed integrally with the indicator which is caused by the pressurizer plate to project on the exterior of the device when the pressurizer plate presses or squeeze the tank to an extent that the tank becomes nearly exhausted, thereby giving the indication of the nearly empty condition to the user for prompting the user to replace the tank.

These and still other objects and advantageous features of the present invention will become apparent from the following detailed description of the preferred embodiments of the present invention when taken in conjunction with the attached drawings.

DETAILED DESCRIPTION OF THE PREFERRED EMBODIMENTS

First Embodiment <FIGS. 1 to 12>

Figure 1:
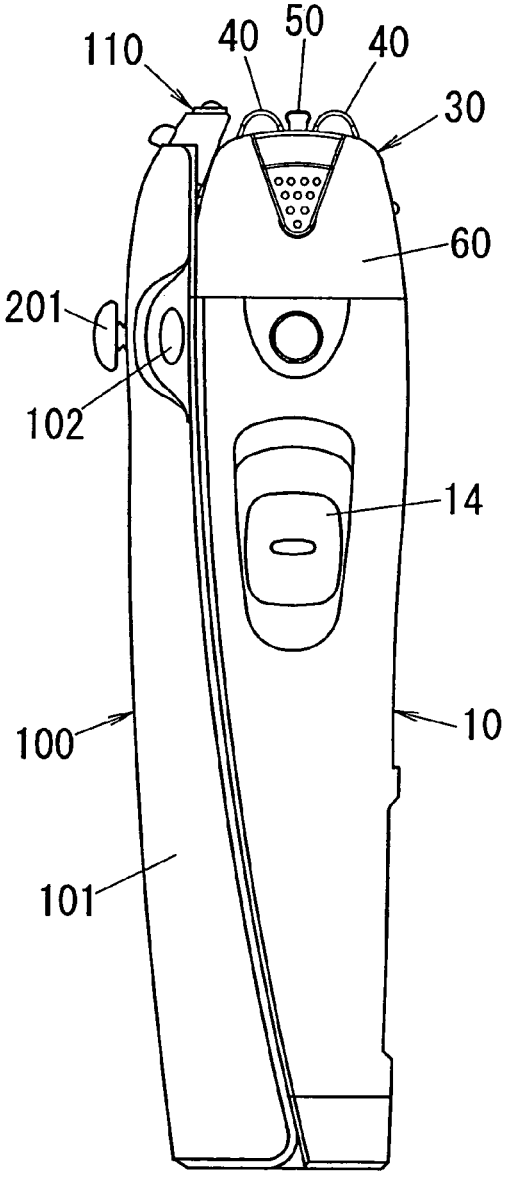
FIG. 1 is a side view of a hair removing device in accordance with a first embodiment of the present invention.
Figure 2:
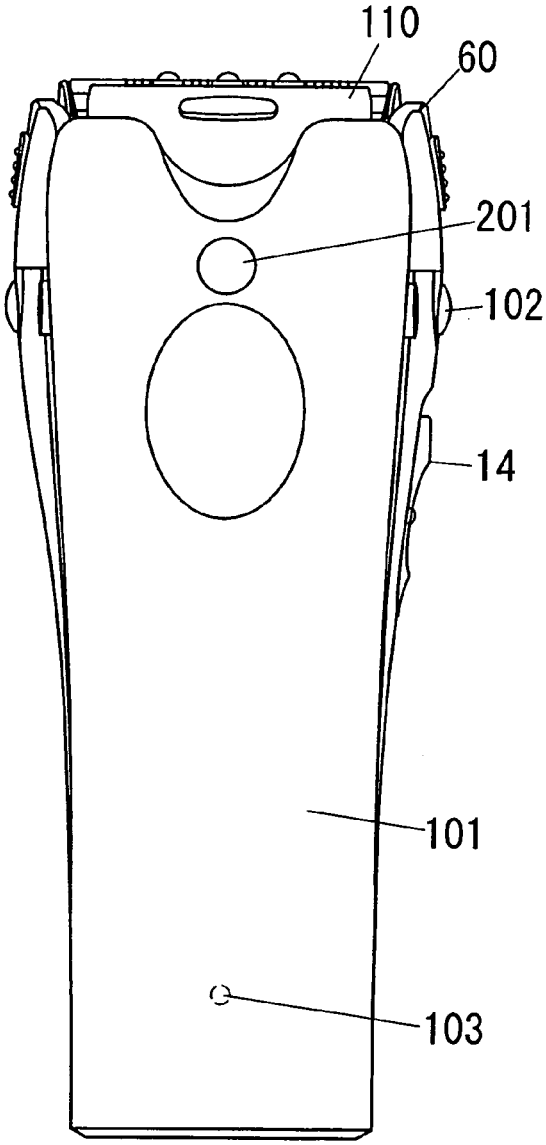
FIG. 2 is a front view of the device.

Referring now to FIG. 1, there is shown a dry shaver as one typical version of the personal hair removing device in accordance with the first embodiment of the present invention. The shaver includes a housing 10 to be grasped by a hand of a user, a shaving head, i.e., a hair removing head 30 projecting on top of the housing, and an applicator 110 projecting adjacent to the hair removing head 30 for dispensing a lotion on a user's skin where the hair removing is made.

The hair removing head 30 is composed of three hair cutting sections, namely, a pair of short-hair cutters 40 and a long-hair cutter 50 interposed between the short-hair cutters 40. The short-hair cutter 40 has a U-shaped outer shearing foil 41 and an inner cutter 42 which is driven to oscillate in shearing engagement with the foil, while the long-hair cutter 50 is composed of a slender outer cutter 51 and an inner cutter 52 driven to oscillate in shearing engagement with the outer cutter. The outer shearing foil 41 and the long hair cutter 50 are floatingly supported to a head frame 60 detachably supported to a base frame 62 which is held on top of the housing 10. The housing 10 incorporates an electric motor 15 which is connected to oscillate driving elements 11 to which the inner cutters 42 and 52 are coupled. The inner cutters 42 are urged upwardly by bias springs 12 so that the short-hair cutters 40 can be depressed when pressed against a user's skin. The long-hair cutter 50 is biased by a like spring provided in the head frame 60 to be capable of being depressed relative to the top frame or the housing. A switch handle 14 is provided on one side of the housing 10 to activate the motor and therefore oscillate the inner cutters for shaving.

Figure 3:
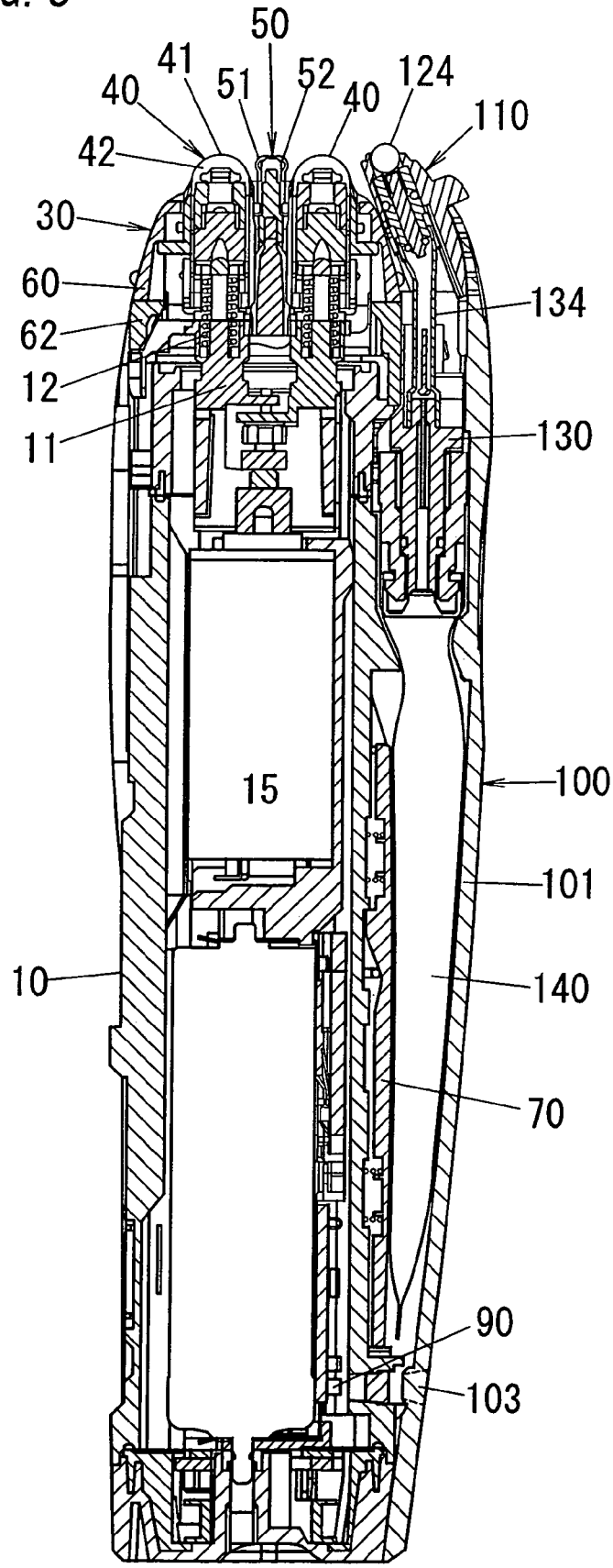
FIG. 3 is a vertical section of the device.
Figure 6:
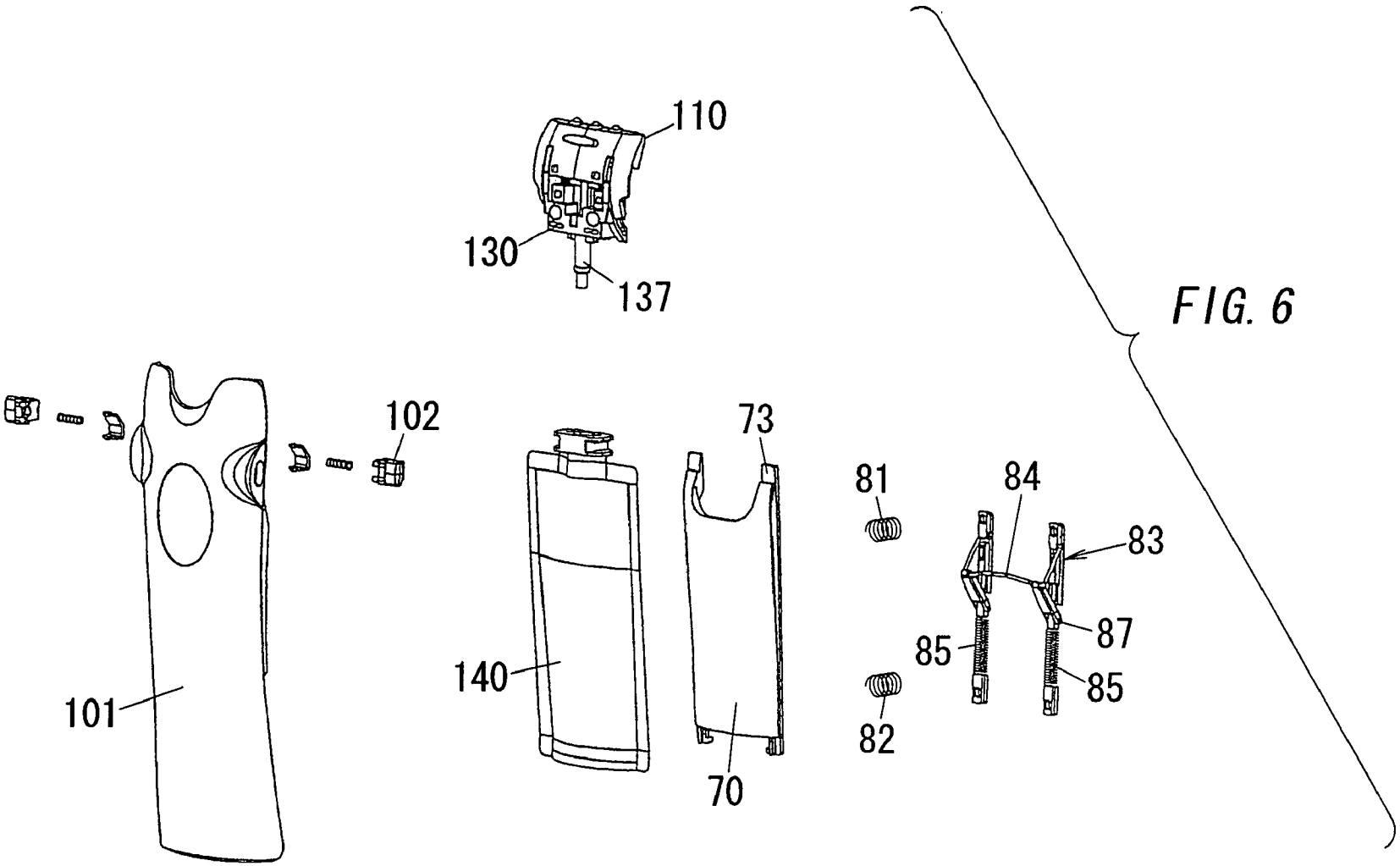
FIG. 6 is an exploded perspective view of the applicator and its associated parts.
Figure 7:
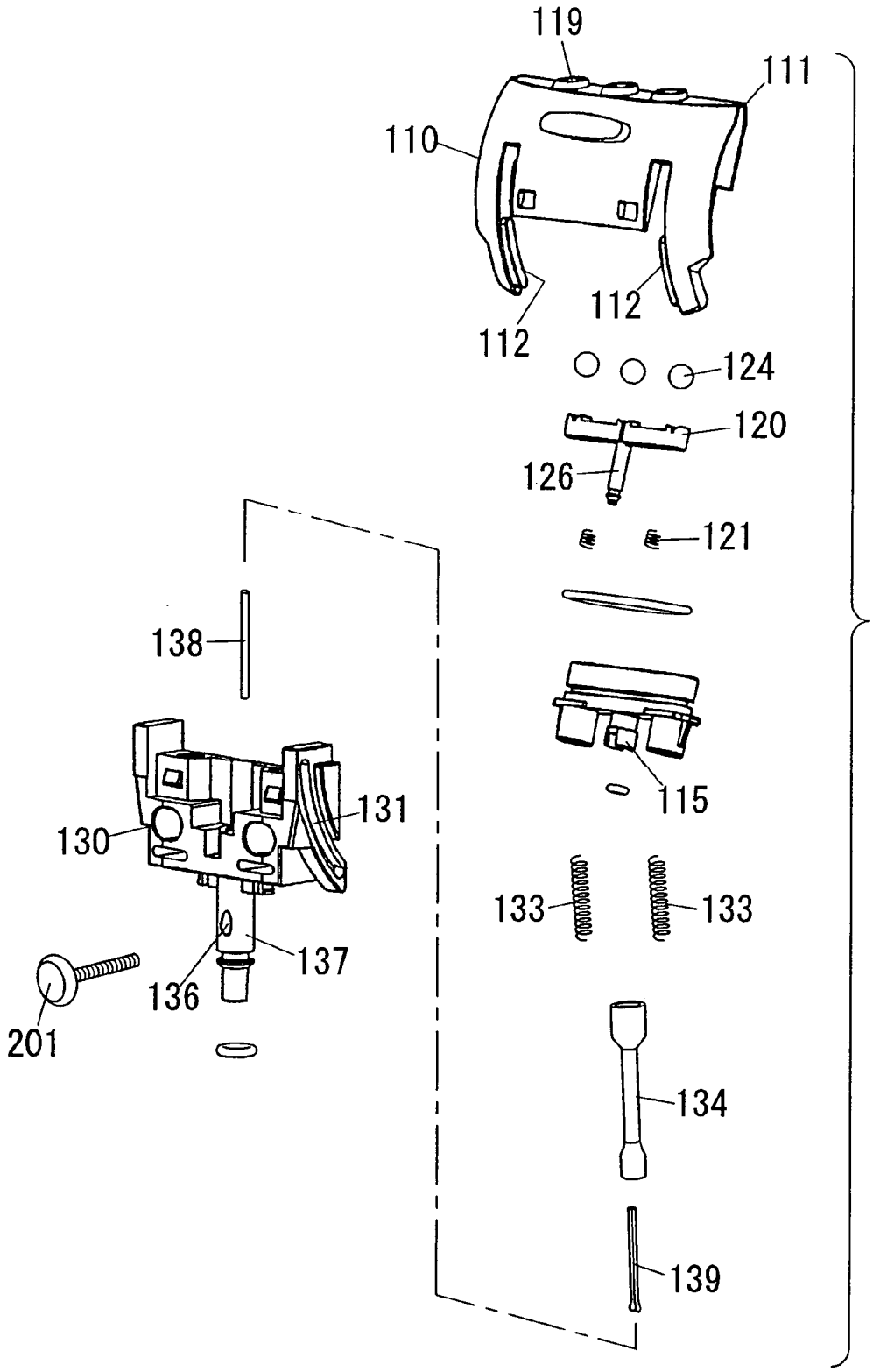
FIG. 7 is an exploded perspective view of the applicator.

Provided on a front face of the housing 10 is a lotion feed module 100 which includes a front cover 101 mounting thereon the applicator 110 at a position adjacent to the short-hair cutter 40 for dispensing the lotion on the user's skin being shaved or to be shaved. The applicator 110 is supplied with the lotion from a tank 140 by means of a lotion supply mechanism which includes a pressurizer 70 for expelling the lotion out of the tank 140 and a feed path extending from the tank 140 to the applicator 110. As shown in FIGS. 3, 6 and 7, the applicator 110 is supported to a holder 130 which is detachably supported to the front cover 101 and is capable of being separated from the front cover together with the applicator 110 and the tank 140 also detachably supported to the holder 130. The front cover 101 is detachably supported to the housing and is provided at its upper lateral sides with release buttons 102 for disengagement of the front cover from the housing 10.

When the front cover 101 is attached to the housing 10, the tank 140 is pressed by the pressurizer 70 in the form of a plate pivotally supported at its lower end to the front lower end of the housing 10. The pressurizer 70 is urged towards the tank 140 by a set of spring devices to squeeze the tank 140 for expelling the lotion out to the applicator 110. As shown in FIGS. 3, 6, 11, and 12, the spring devices includes a pair of vertically spaced coil springs 81 and 82 held between the pressurizer 70 and the housing 10, and a spring loaded pusher 83 with a lever 84 in pressing contact with the pressurizer.

Referring to FIG. 7, the holder 130 is configured to movably support the applicator 110 relative to the holder in such a manner that the applicator 110 is oriented to have its top lotion dispensing end in closely adjacent relation to the short-hair cutter 40 when the applicator is held in its upper most position, as shown in FIG. 1. As the applicator 110 is depressed, it becomes closer to straight in order to avoid interfering with the short-hair cutter 40. For this purpose, the holder 130 includes a pair of arcuate grooves 131 for slidably receiving fins 112 on opposite side of the applicator 110. Coils springs 133 are interposed between the holder 130 and the applicator 110 to bias the applicator upwardly, i.e., floatingly support the applicator 110, whereby the applicator 110 is permitted to follow the contour of the skin easily while the shaver is manipulated to move across the skin. As the applicator 110 is depressed against the bias of the springs 133, the fins 112 are guided along the length of the grooves 131 to change the posture of the applicator relative to the hair removing head 30.

Figure 8:
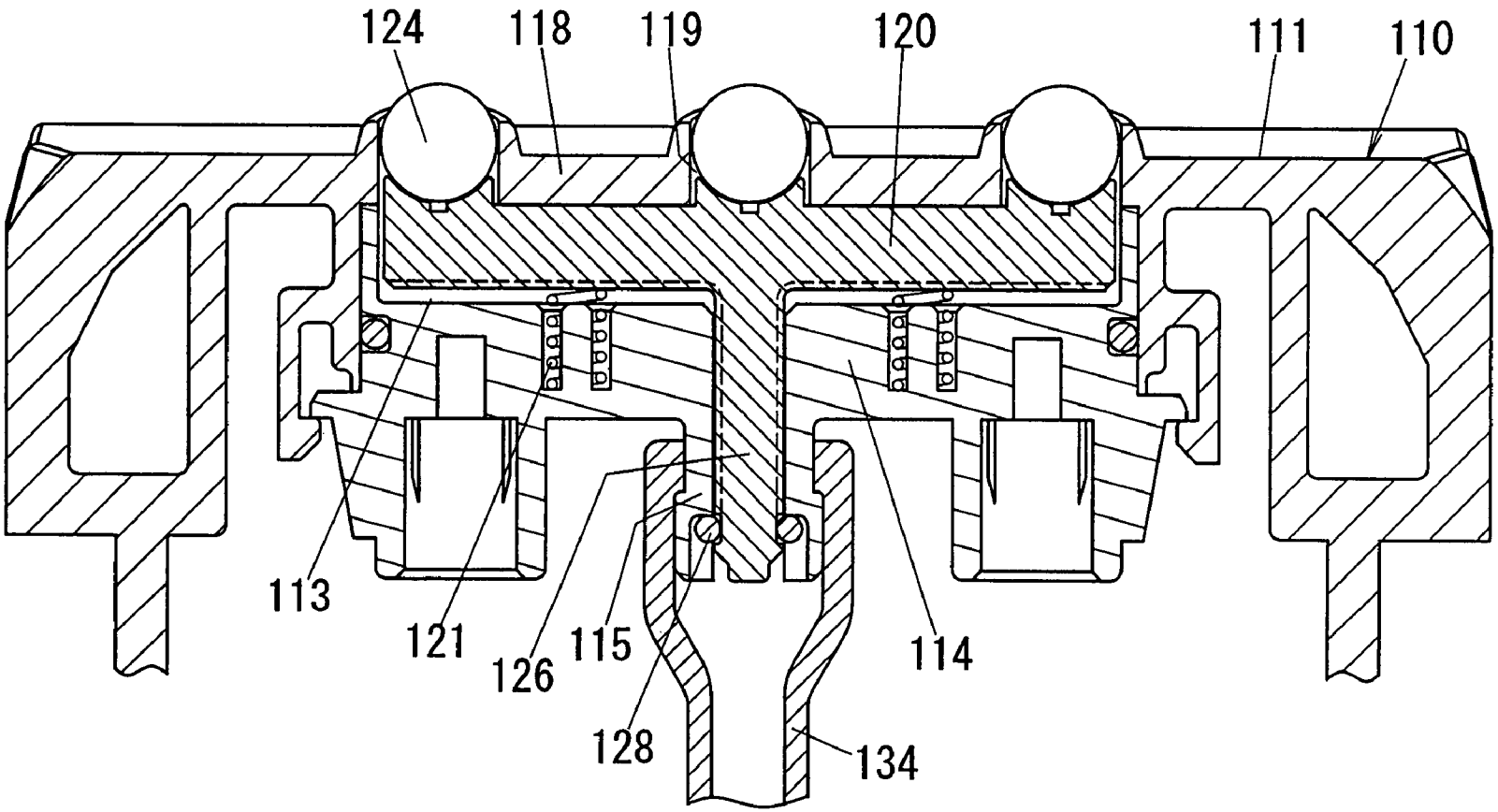
FIGS. 8 and 9 are sectional views illustrating the lotion dispensing actions of the applicator, respectively.
Figure 9:
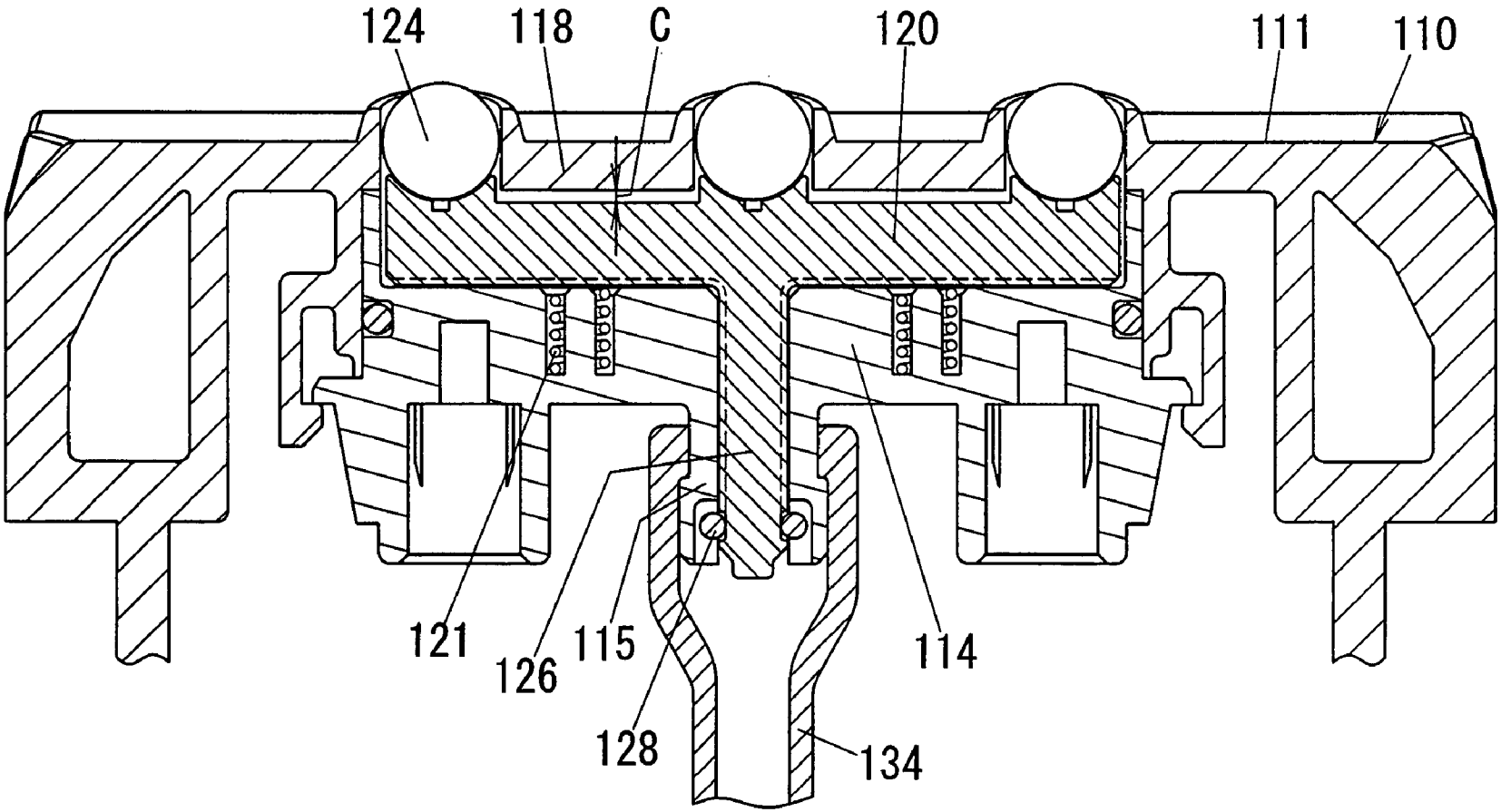

As best shown in FIGS. 7, 8 and 9, the applicator 110 includes a header 111 having a chamber 113 for temporarily storing the lotion supplied from the tank 140. In detail, the header 111 is in the form of a hollow casing with a bottom wall 114 and a top wall 118, and includes a floating bed 120 which is vertically movable within the chamber and is floatingly supported to the bottom wall 114 by means of coil springs 121. A plurality of rotating elements or balls 124 are loosely fitted respectively within apertures 119 formed in the top wall 118 so as to come into rolling contact with the skin when the applicator 110 is held against the skin. The apertures 119 communicate with the chamber 113 such that the lotion passes through a clearance between the aperture 119 and the ball 124 for dispensing the lotion over the skin while the balls rotate in contact with the skin. The balls 124 are supported on the floating bed 120 so as to be capable of being depressed together therewith against the bias of the springs 121, as shown in FIG. 9, as a consequence of the applicator 110 being pressed against the skin.

Figure 5:
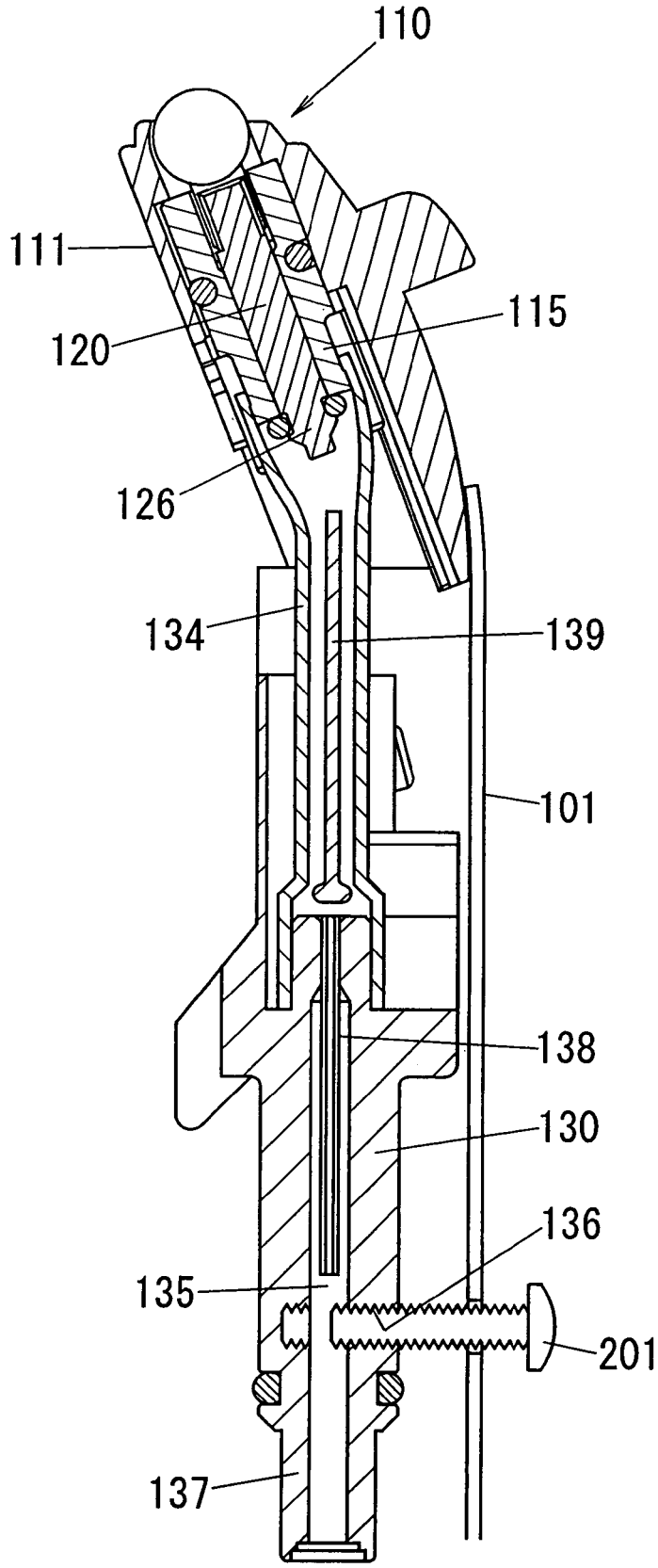
FIG. 5 is vertical section showing a lotion applicator included in the device.

Projecting downwardly from the bottom wall 114 is a sleeve 115 which communicates with the chamber 113 and is secured to one end of a flexible hose 134 leading to a conduit 135 which extends through the holder 130, as best shown in FIG. 5. The conduit 135 projects from the holder 130 to define a plug tube 137 for detachable connection to the tank 140. Thus, the hose 134, the conduit 135, and the plug tube 137 are cooperative to constitute the lotion feed path from the tank 140 to the applicator 110.

Projecting downward from the floating bed 120 is a stem 126 which extends loosely through the sleeve 115 and is provided at its bottom with a stop valve 128 in sealing contact with a bottom open end of the sleeve 115, whereby the lotion feed path from the tank 140 to the applicator is normally closed by the stop valve 128, as shown in FIG. 8. The stop valve 128 is opened only when the floating bed 120 is depressed together with the balls 124, as shown in FIG. 9. Thus, the lotion under being pressurized in the tank 140 can be supplied to the applicator 110 in response to the balls 124 being pressed against the user's skin. In this sense, the stop valve 128 is cooperative with the pressurizer 70 to supply the lotion from the tank 140 to the applicator 110, and the balls 124 activates to dispense the lotion from the tank 140 to the applicator 110 for applying the lotion over the skin. Due to the flexible nature, the hose 134 absorbs the resulting displacement of the applicator 110 relative to the tank 140. It is noted in this connection, as the balls 124 is depressed or lowered together with the floating bed 120, as shown in FIG. 9, the balls 124 are caused to rotate freely for smooth rolling contact with the skin, and therefore efficient lotion feeding over the skin. In this condition, a gap or riser channel is formed between the stem 126 and the sleeve 115 to extend into an enlarged clearance C between the lowered floating bed 120 and the top wall 118, thereby dispensing the lotion on the user's skin by the action of the balls 124. It should be noted here that since the applicator 110 is held in closely adjacent relation to the hair removing head 30, the actuator in the form of the balls 124 can be mobilized or depressed when the hair removing head 30 comes into an operative condition for hair shaving, enabling to apply the lotion over the skin easily in association with the shaving, yet requiring no extra switching operation other than pressing the applicator against the user's skin.

Turning back to FIG. 5, the holder 130 is provided with a manipulator 201 in the form of a screw for regulating the amount of the lotion being dispensed from the applicator 110. One end of the manipulator 201 extends through the conduit 135 of the holder 130 in threaded engagement into a threaded hole 136 in the holder 130 in order to vary the cross-section of the conduit 135 and therefore the flow rate of the lotion passing through the lotion feed path. The other end of the manipulator 201 projects on the front cover 101 to be accessible by the fingers of the user so that the user can regulate the dispensing amount of the lotion by advancing or retracting the manipulator 201. When advancing the manipulator 201 to its maximum extent, it closes the conduit 135 to stop feeding the lotion towards the applicator 110. Thus, the manipulator 201 constitutes a regulating means for regulating the dispensing amount of the lotion from the applicator. Also seen in FIG. 5, the conduit 135 and the hose 134 are provided respectively with a pipe 138 and a rubber core 139 in order to reduce the internal volume of the lotion feed path or minimize the amount of the lotion remaining in the lotion feed path when the tank is detached from the holder 130, thereby minimizing the leakage amount of the lotion from the lotion feed path upon detachment of the tank 140.

Figure 4:
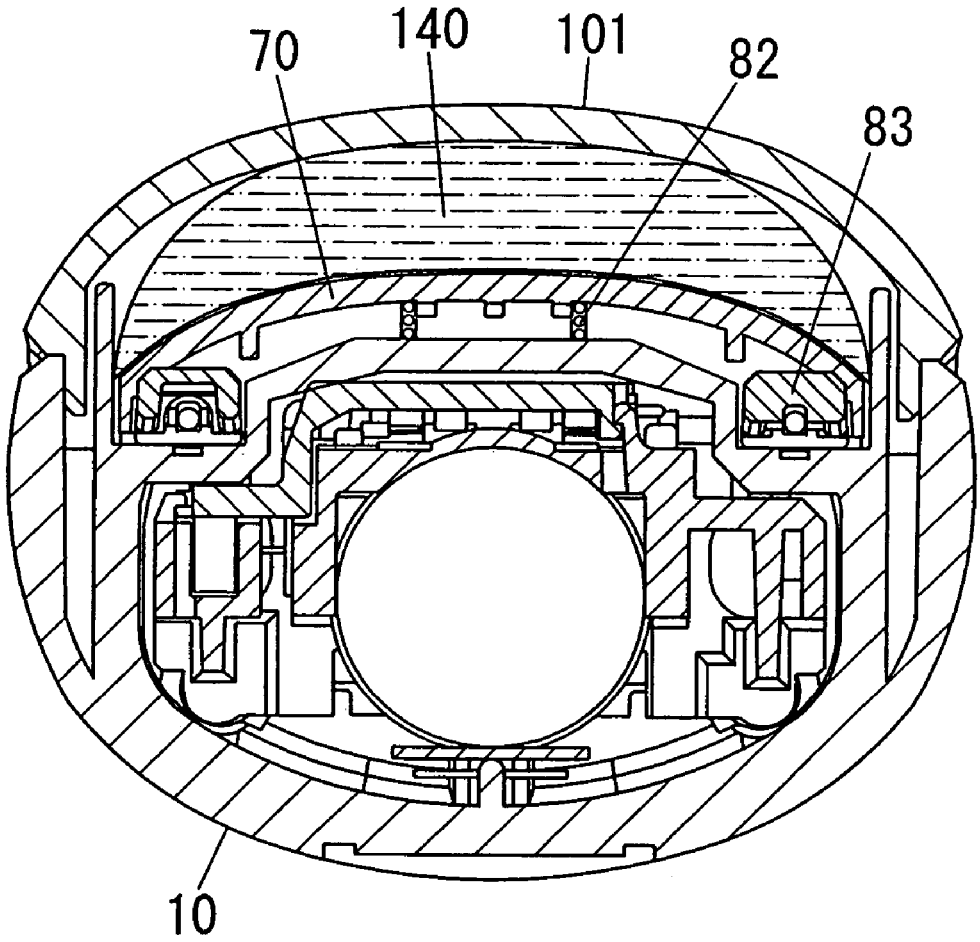
FIG. 4 is a horizontal section of the device.
Figure 10:
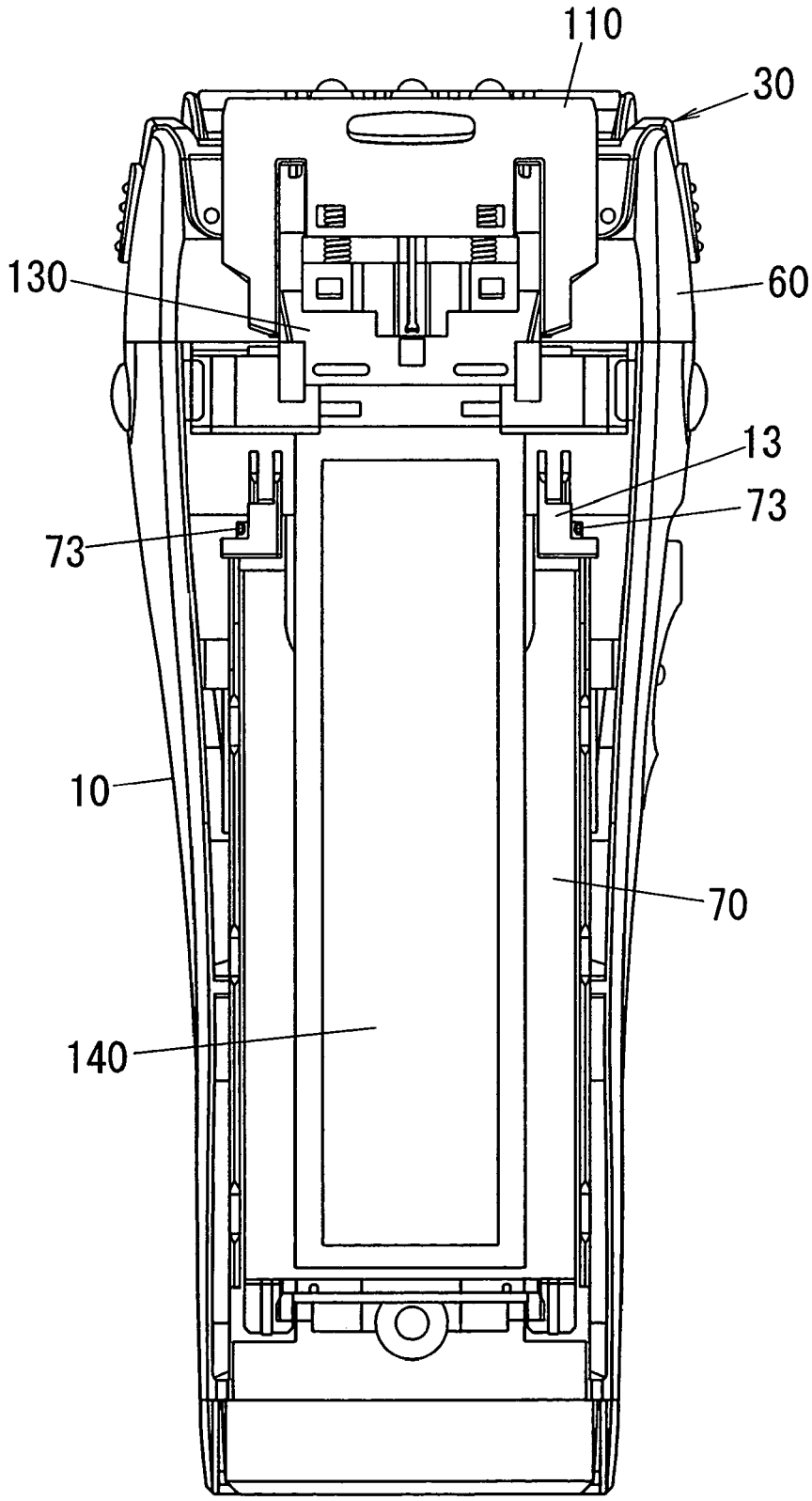
FIG. 10 is a front view of the device shown with some parts removed.
Figure 11:
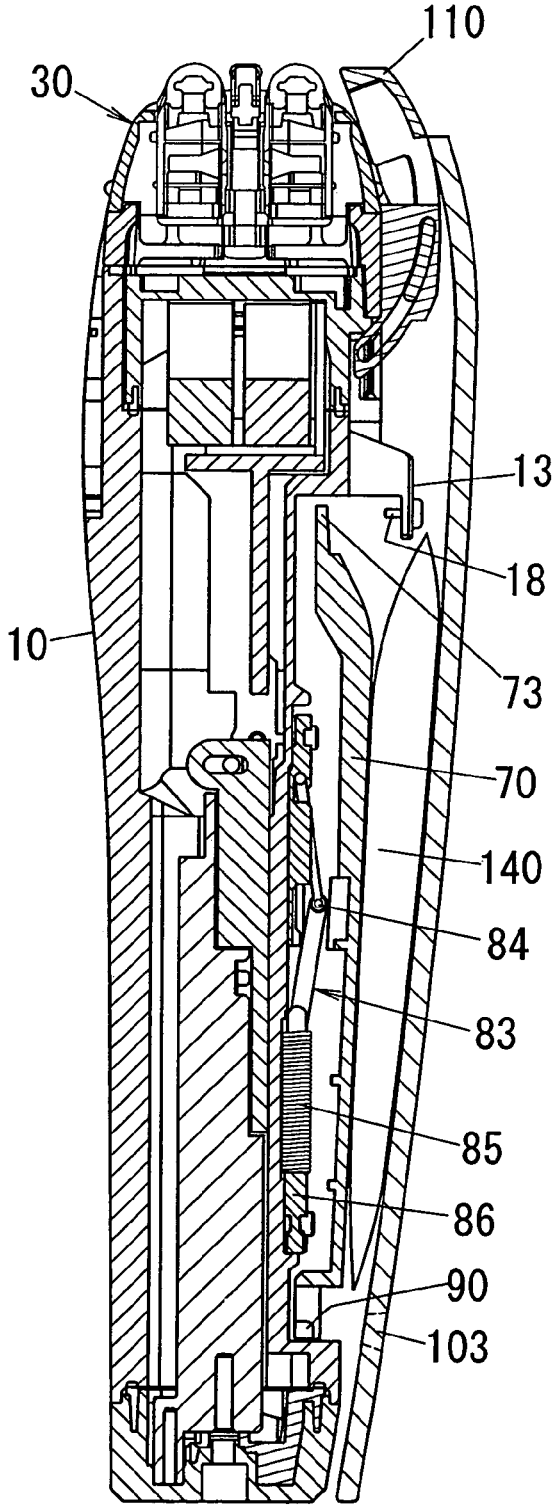
FIGS. 11 and 12 are vertical sections of the device, respectively.
Figure 12:
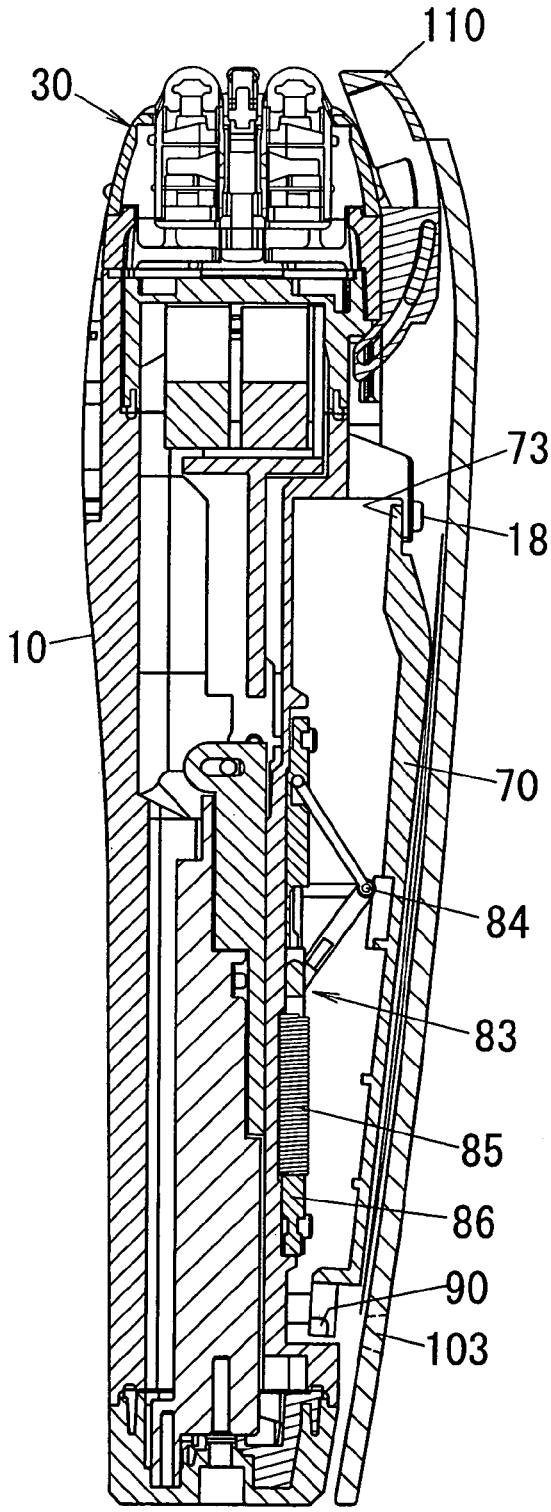

As shown in FIG. 4, the pressurizer 70 is shaped to have its surface conforming to the inner rounded surface of the front cover 101 for squeezing the flexible tank 140 to a maximum extent. Further, as shown in FIG. 10, the pressurizer 70 may be formed to have a wider width than that of the tank for the same purpose. When the tank 140 is squeezed from a fully-filled condition of FIG. 11 to a nearly empty condition of FIG. 12, projections 73 at the upper end of the pressurizer 70 abut against stoppers 13 integrally extending from the housing 10. One of the stoppers 13 is provided with a sensor switch 18 which is actuated by the projection 73 to close an electric circuit incorporated in the housing for energizing a light emitting diode (LED) 90 located at the lower end of the housing 10. The LED 90 is viewed through a corresponding window 103 at the lower end of the cover such that the LED acts as an indicator to inform the user of the empty condition of the tank, prompting the user to replace the tank.

Figure 13:
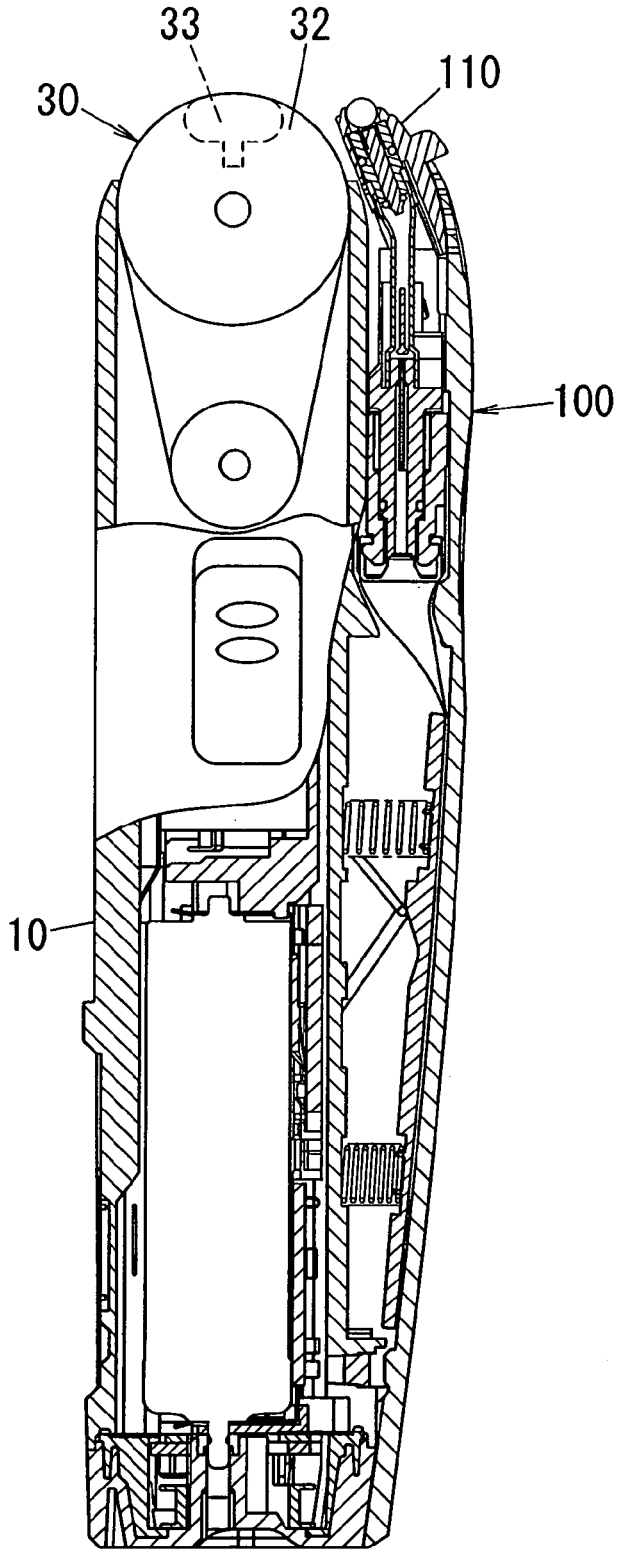
FIG. 13 is a vertical view of a modification of the above embodiment.

Although the above embodiment illustrates the shaver as one typical example of the hair removing device, the present invention can be equally applied to a hair epilating device, as shown in FIG. 13, which includes a hair epilating head 30 provided with a cylinder 32 carrying hair pinching blades 33. The cylinder 32 is driven by the incorporated motor to rotate about a horizontal axis, during which the pinching blades 33 are caused to open and close repeatedly to thereby pinch the hair and pluck it from the user's skin.

Figure 14:
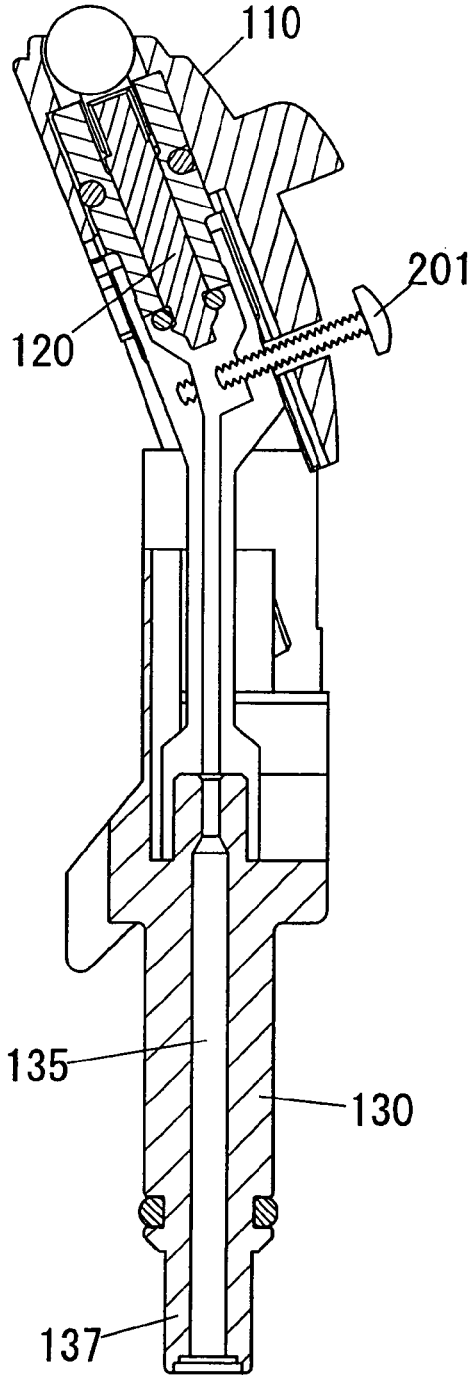
FIG. 14 is a partial section of an applicator in accordance with another modification of the above embodiment.

Further, in the above embodiment, the manipulator 201 is shown to be coupled to the holder 130, the manipulator 201 may be coupled to the applicator 110 itself for varying the cross-section of the lotion feed path immediately upstream of the applicator, as shown in FIG. 14.

Figure 15:
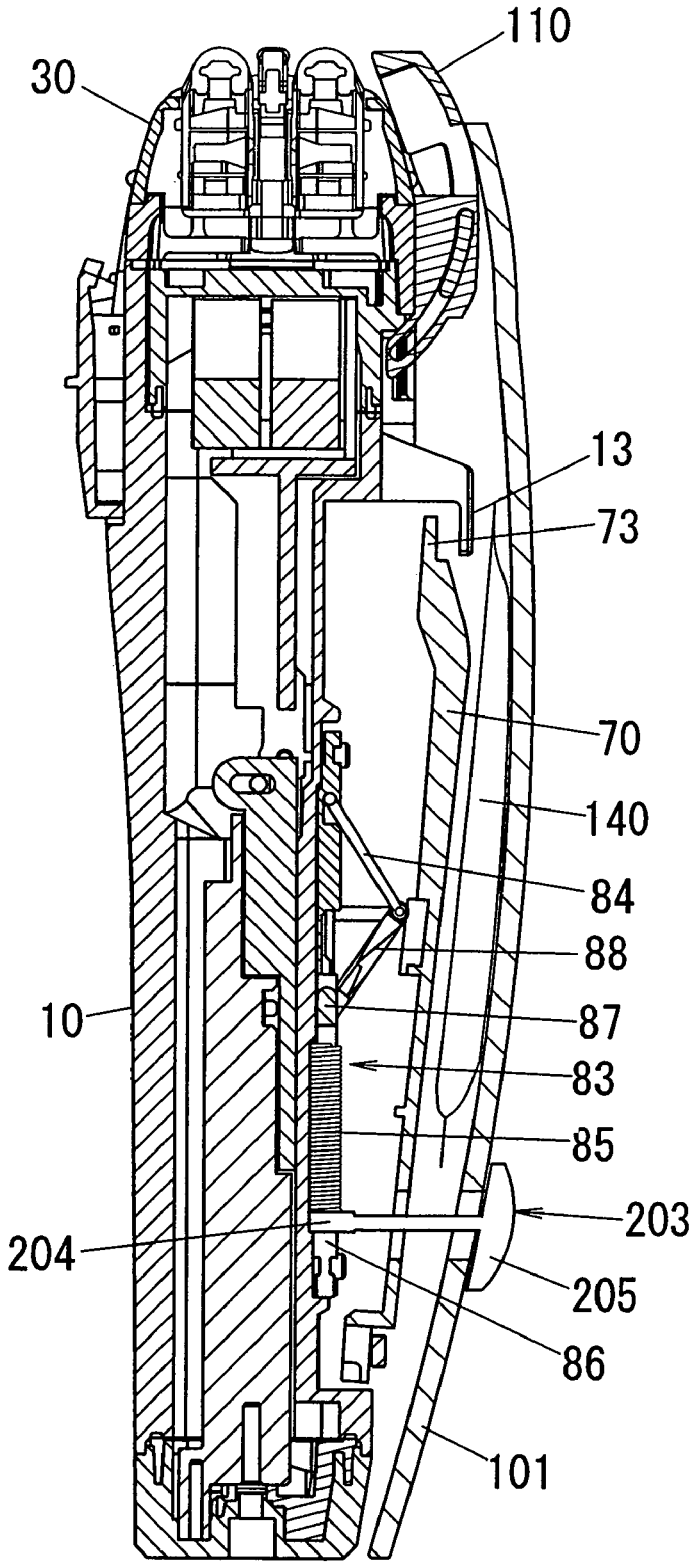
FIG. 15 is a vertical section of a device in accordance with a second embodiment of the present invention.

Second Embodiment <FIG. 15>

FIG. 15 illustrates a second embodiment of the present invention in which the pressurizer 70 is made to vary its pressing force to the tank 140 for regulating the dispensing amount of the lotion. The other structures and the functions are identical to the first embodiment so that no duplicate explanation is made here and like parts are designated by like reference numerals. In this embodiment, the spring-loaded pusher 83 urging the pressurizer 70 is cooperative with a handle 203 to constitute a regulating means or system for regulating the dispensing amount of the lotion. As shown in FIGS. 6 and 15, the pusher 83 comprises a pair of coil springs 85 fitted respectively around vertical rods 86 secured to the housing 10, and a pair of sliders 87 connected to the upper end of the coil springs 85. The sliders 87 are slidable along the length of the respective rods 86 and are each provided with a pivot arm 88 having one end pivotally connected to the slider and the other end pivotally connected to the lever 84. The lever 84 has its upper ends pivotally supported to the housing 10 so that lever 84 is urged towards away from the housing by the action of the coil springs 85 for giving to the pressurizer 70 the force of pressurizing the tank 140. It is these coil springs 85 that are adjusted to vary the pressing force of the pressurizer 70 for regulating the dispensing amount of the lotion. The handle 203 has its inner ends 204 slidably fitted around the rods 86 in supporting relation respectively with the lower ends of the coil springs 85 so as to adjust the compressing force of the springs by moving the handle vertically. For this purpose, the handle 203 is provided with an adjustor knob 205 exposed on the exterior of the front cover 101 to be accessible by the user's hand. The handle 203 is normally biased to a lowermost position by the coil springs 85 and is manipulated to temporarily move upwardly against the bias of the coils springs 85 as the user wishes to increase the dispensing amount of the lotion. Alternatively, the handle 203 may be clicked into any desired position by means of a detent mechanism or the like for retaining the handle or keeping the intended dispensing amount of the lotion.

Figure 16:
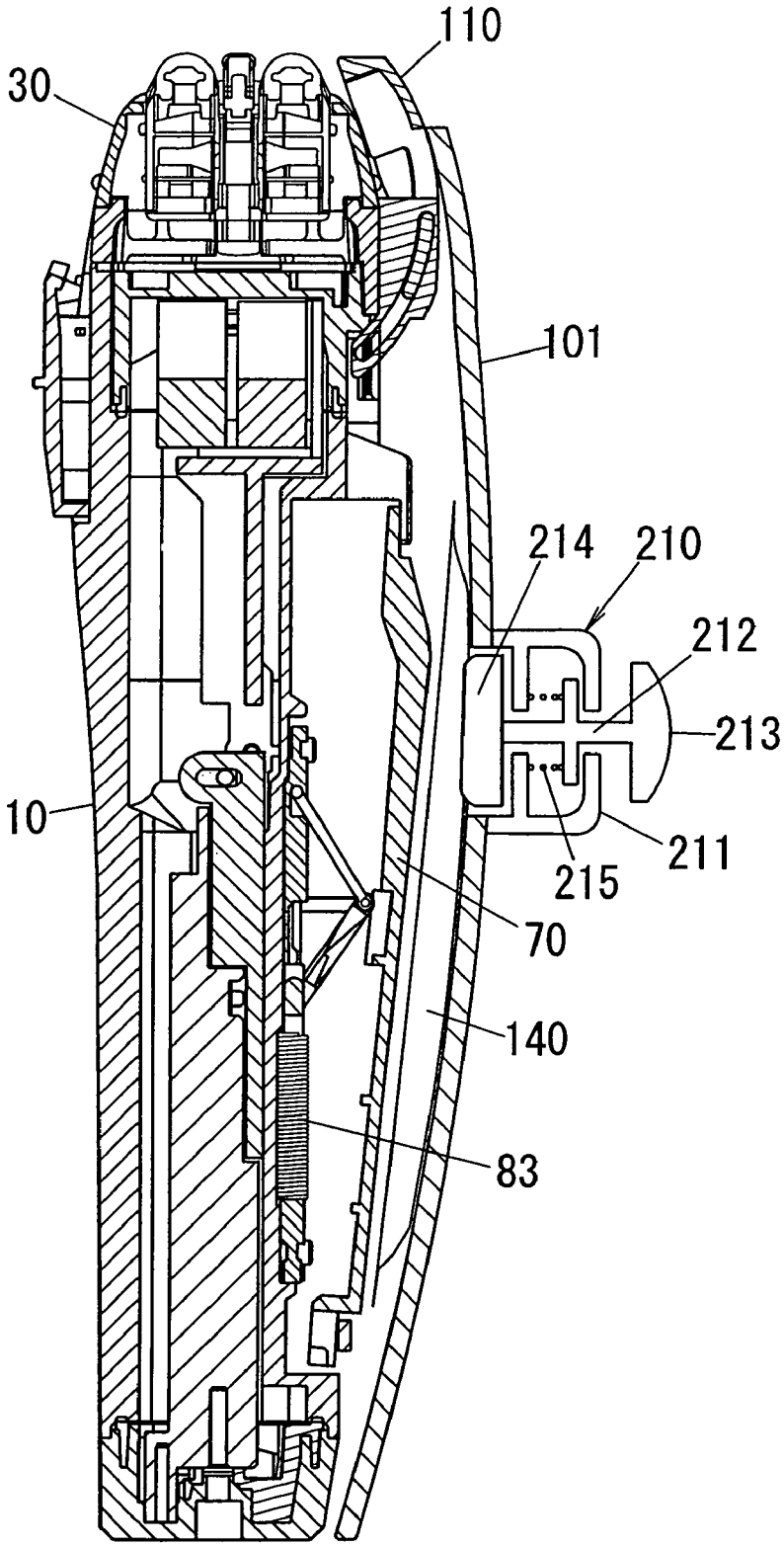
FIG. 16 is a vertical section of a device in accordance with a third embodiment of the present invention.

Third Embodiment <FIG. 16>

FIG. 16 illustrates a third embodiment of the present invention in which the tank 140 receives an additional pressing force by a manual compressor 210 which constitutes a regulating system for regulating the dispensing amount of the liquid from the applicator 110. The other structures and the functions are identical to the first embodiment so that no duplicate explanation is made here and like parts are designated by like reference numerals. The compressor 210 comprises a frame 211 secured to the front cover 101 and carrying a handle 212 with a knob 213, a pad 214, aid a spring 215 urging the handle 212 away from tank 140. The pad 214 extends through the front cover 101 to come into pressing contact with the tank 140 to give an additional pressure for squeezing the tank 140 independently of the pressurizer 70. Thus, the manual compressor 210 develops the squeezing force that varies with the pressing force applied to the knob 213 by the user, thereby enabling to regulate the dispensing amount of the liquid from the applicator 110.

Figure 17:
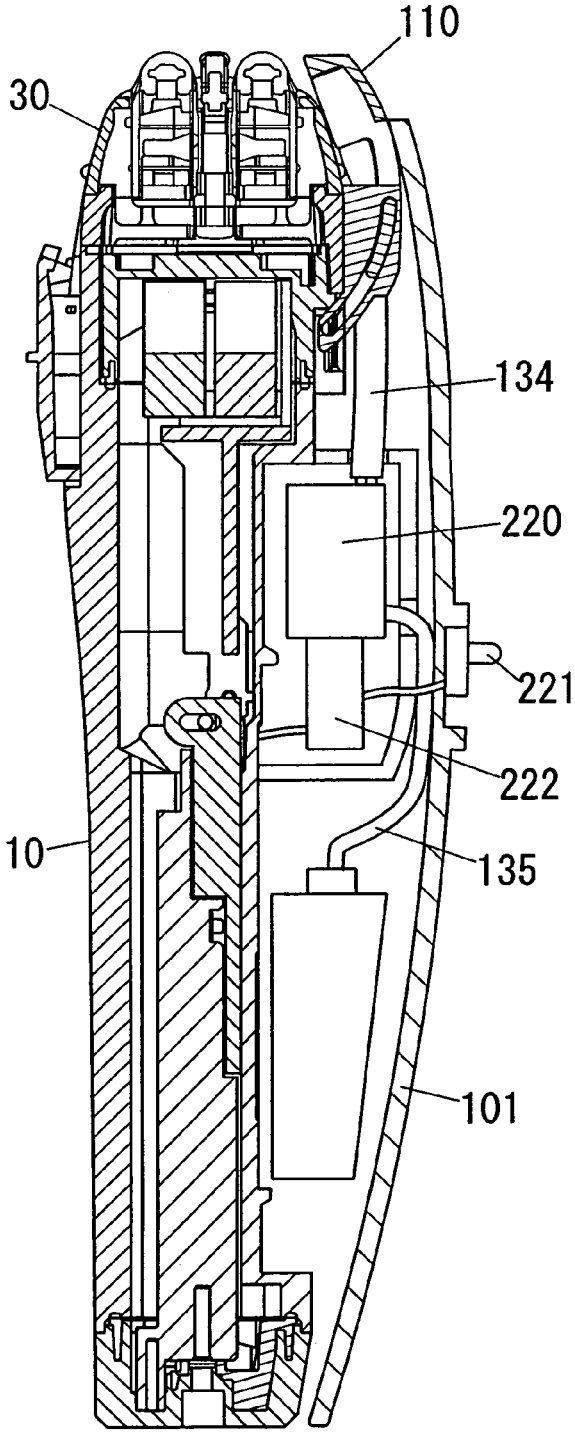
FIG. 17 is a vertical section of a device in accordance with a fourth embodiment of the present invention.

Fourth Embodiment <FIG. 17>

FIG. 17 illustrates a fourth embodiment of the present invention in which a powered pump 220 is utilized to expel the lotion from the tank to the applicator 110 and a switch handle 221 which varies pump capacity of the pump for regulating the dispensing amount of the lotion from the applicator. The other structures and the functions are identical to the first embodiment so that no duplicate explanation is made here and like parts are designated by like reference numerals. The pump 220 is powered by an electric motor 222 of which power is adjusted by the switch handle 221 mounted on the exterior of the front cover 101 and accessible by the user. The pump 220 has its inlet connected to a flexible conduit 135 detachable to the tank 140 and has its outlet connected to the applicator by means of a flexible hose 134. The switch handle 221 has an additional stop position of ceasing the pump 220 and therefore disabling the applicator from dispensing the lotion.

Figure 18:
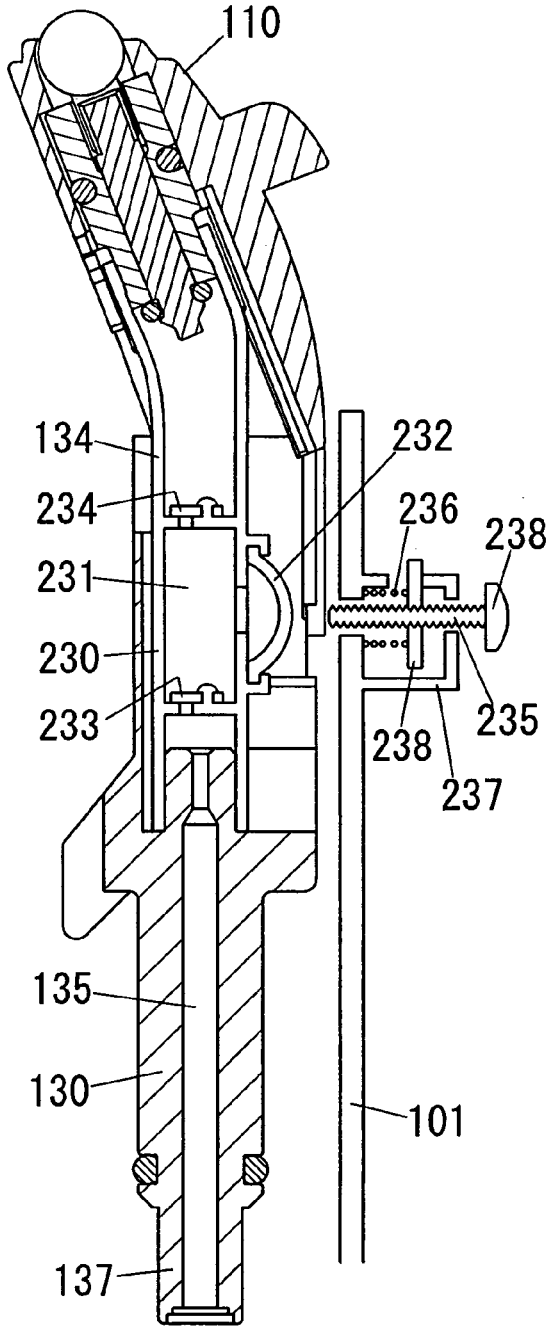
FIG. 18 is a partial vertical section of a device in accordance with a fifth embodiment of the present invention.

Fifth Embodiment <FIG. 18>

FIG. 18 illustrates a fifth embodiment of the present invention in which a manual diaphragm pump 230 is included in the lotion feed path extending from the holder 130 to the applicator 110 for regulating the dispensing amount of the lotion from the applicator. The other structures and the functions are identical to the first embodiment so that no duplicate explanation is made here and like parts are designated by like reference numerals. The diaphragm pump 230 has a pump chamber 231 and a diaphragm 232 varying the volume of the chamber. The pump chamber 231 is provided midway in the hose 134 between the holder 130 and the applicator 110, and includes inlet valve 233 for allowing the lotion to be sucked into the chamber from the tank through the conduit 135, and an outlet valve 234 for allowing the lotion to be expelled from the chamber to the applicator. Associated with the pump 230 is a manipulator 235 in the form of a screw that is supported to the front cover 101 to be movable in the axial direction, and is biased by a spring 236 to move away from the diaphragm 232. A knob 238 is formed at one end of the manipulator 235 and projects out of a frame 237 attaching the manipulator 235 to the front cover 101 to be accessible by the finger of the user. The diaphragm 232 is actuated manually to introduce the lotion into the chamber by pressing the knob 238 and to pump the lotion out of the chamber to the applicator 110 by releasing the knob. In other words, the pump gives an additional pressure for feeding the lotion to the applicator and therefore dispensing the lotion from the applicator. Thus, it is readily possible to vary the dispensing amount of the lotion by manually activating the diaphragm pump. It is noted in this connection, the manual pump can be alone provided or in combination with the pressurizer 70 as discussed hereinbefore for feeding the lotion from the tank to the applicator, i.e., supplying the pressurized lotion to the applicator 110. Further, the manipulator 235 is provided with an adjustor dial 238 or nut for adjusting a projecting amount of the manipulator towards the diaphragm 232 and therefore a deforming amount of the diaphragm to adjust the flow rate of the lotion being fed to the applicator 110, or the pump capacity per one pushing of the manipulator. The adjustor dial 238 may be moved to a stop position where the manipulator cannot reach the diaphragm for disabling the diaphragm pump.

Figure 19:
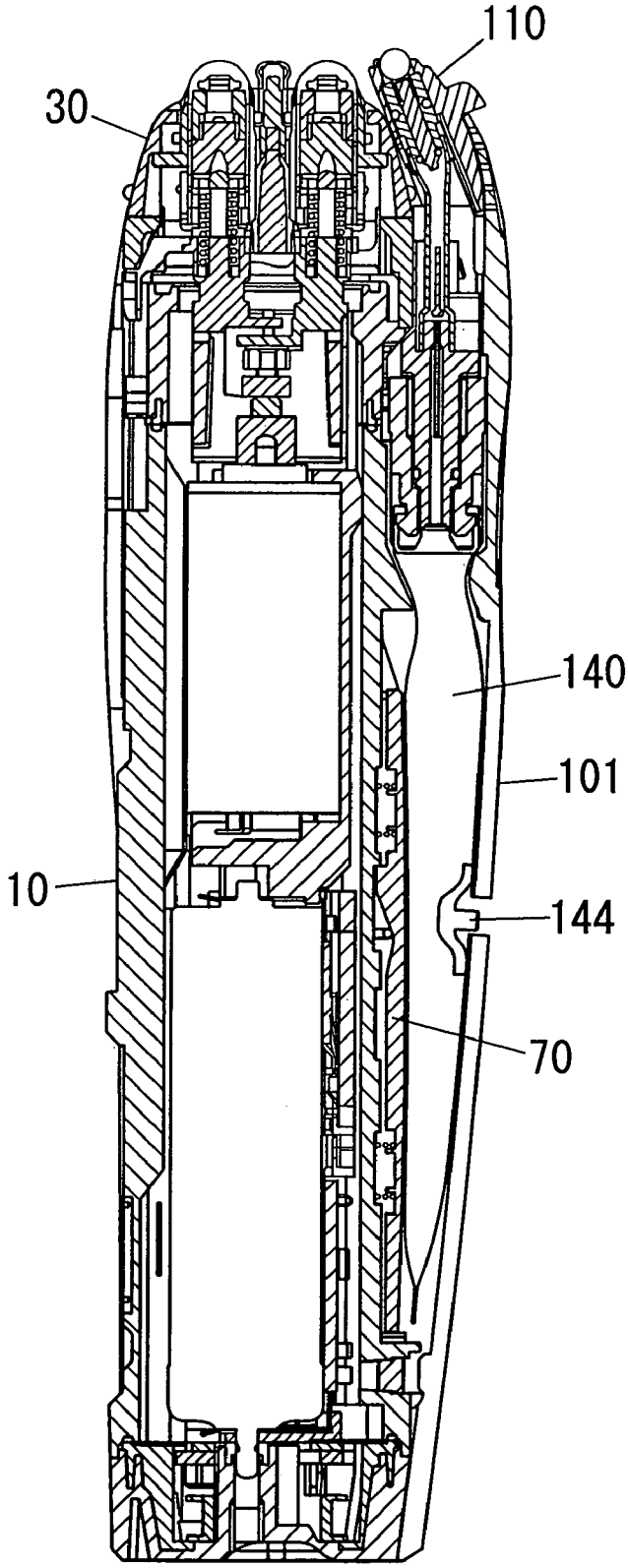
FIG. 19 is a vertical section of a device in accordance with a sixth embodiment of the present invention.

Sixth Embodiment <FIGS. 19 and 20>

Figure 20C:
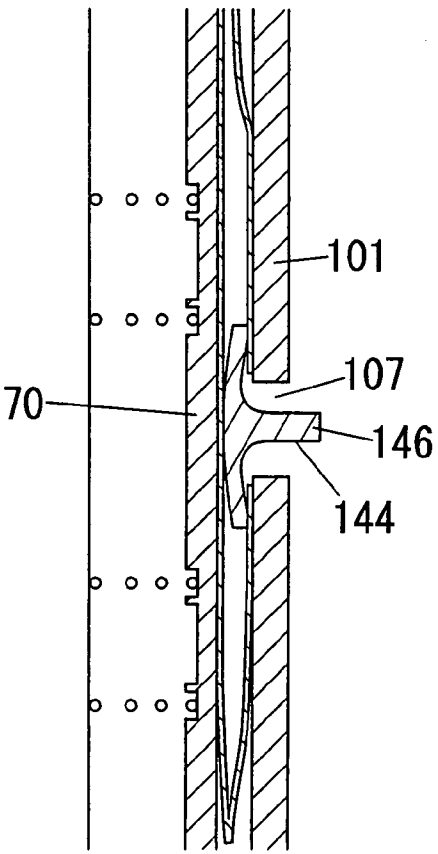
FIGS. 20A, 20B, and 20C are diagrams showing the operation of an indicator of the above device, respectively.
Figure 20B:
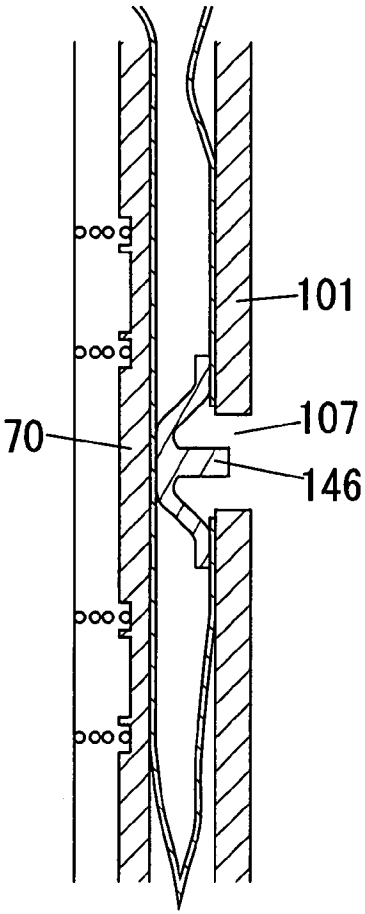
Figure 20A:
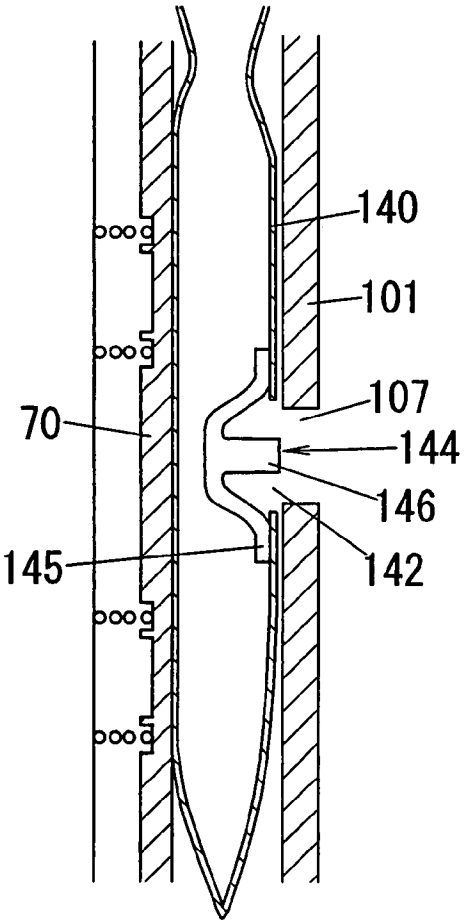
Figure 21:
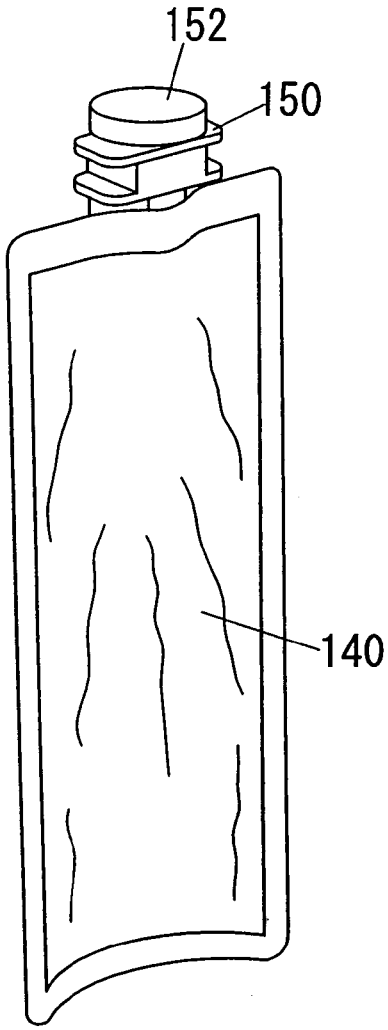
FIG. 21 is a perspective view of a tank utilized in the above device.
Figure 22:
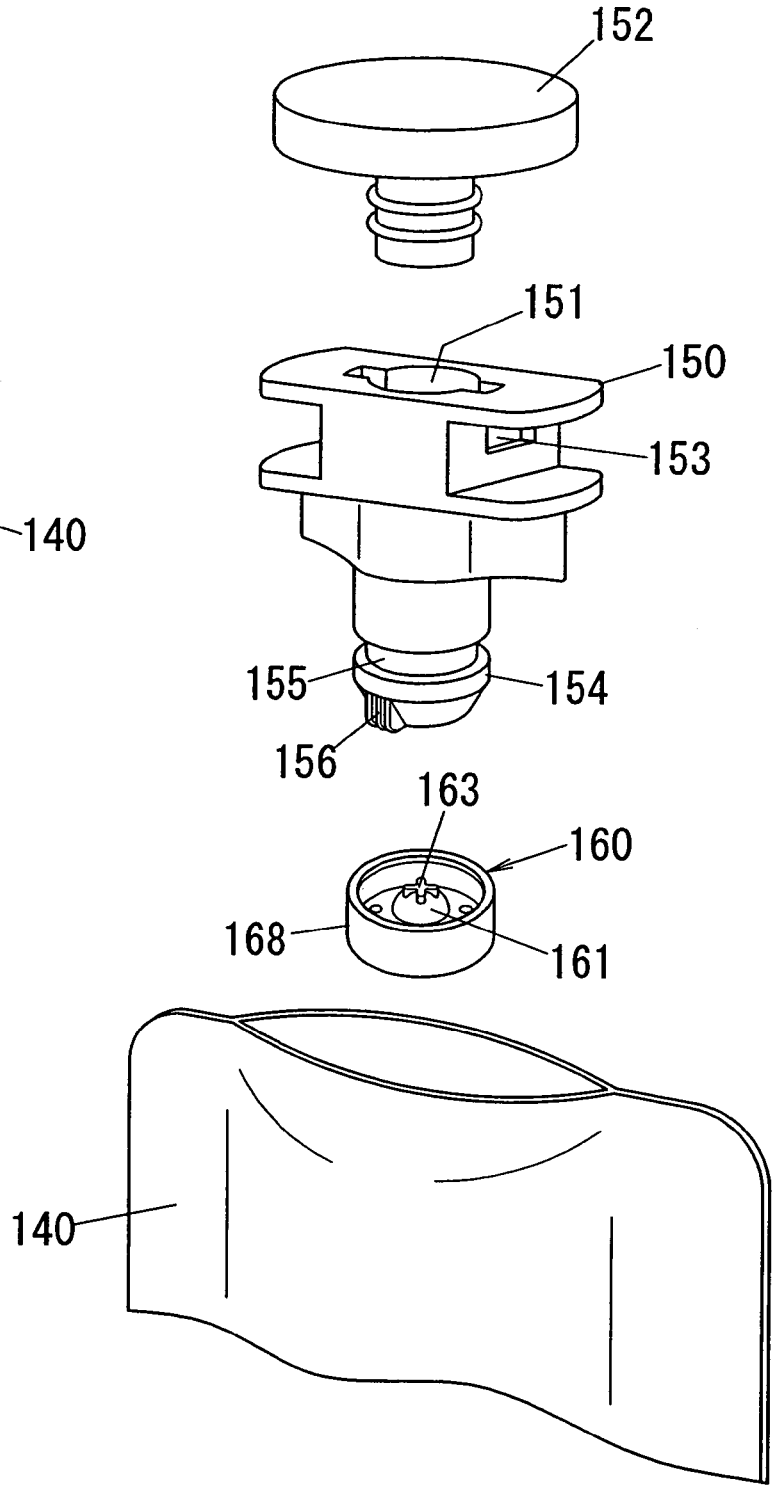
FIG. 22 is an exploded perspective view of the tank.

FIGS. 19 and 20 illustrate a sixth embodiment of the present invention which is identical to the first embodiment except that a mechanical indicator 144 is carried on the tank for indication of the amount of the lotion remaining in the tank 140. The other structures and operations are identical to the first embodiment. Therefore, no duplicate explanation is made herein and like parts are designated by like reference numerals. The tank 140 is provided with the indicator 144 which is made of an elastic material and shaped into a bowl with a center stud 146. As shown in FIG. 20, the bowl has its brim 145 sealed around a hole 142 in the tank 140 with the center stud 146 located in the center of the hole 142 which is in direct communication with a window 107 in the front cover 101. At the fully-filled condition of the tank 140 (FIG. 20A), the bottom of the indicator 144 is spaced from the opposite wall of the tank to locate the stud 146 not projecting into the window 107. As the tank 140 is squeezed from its half-empty condition to a nearly empty condition by the action of the pressurizer 70, the indicator 144 is pushed by the pressurizer to advance the distal end of the stud 146 from a mid-position within the window 107 (FIG. 20B) to a projected position on the exterior of the front cover 101 (FIG. 20C). Thus, the indicator 144 gives a clear indication of the amount of the lotion remaining in the tank.

Figure 23:
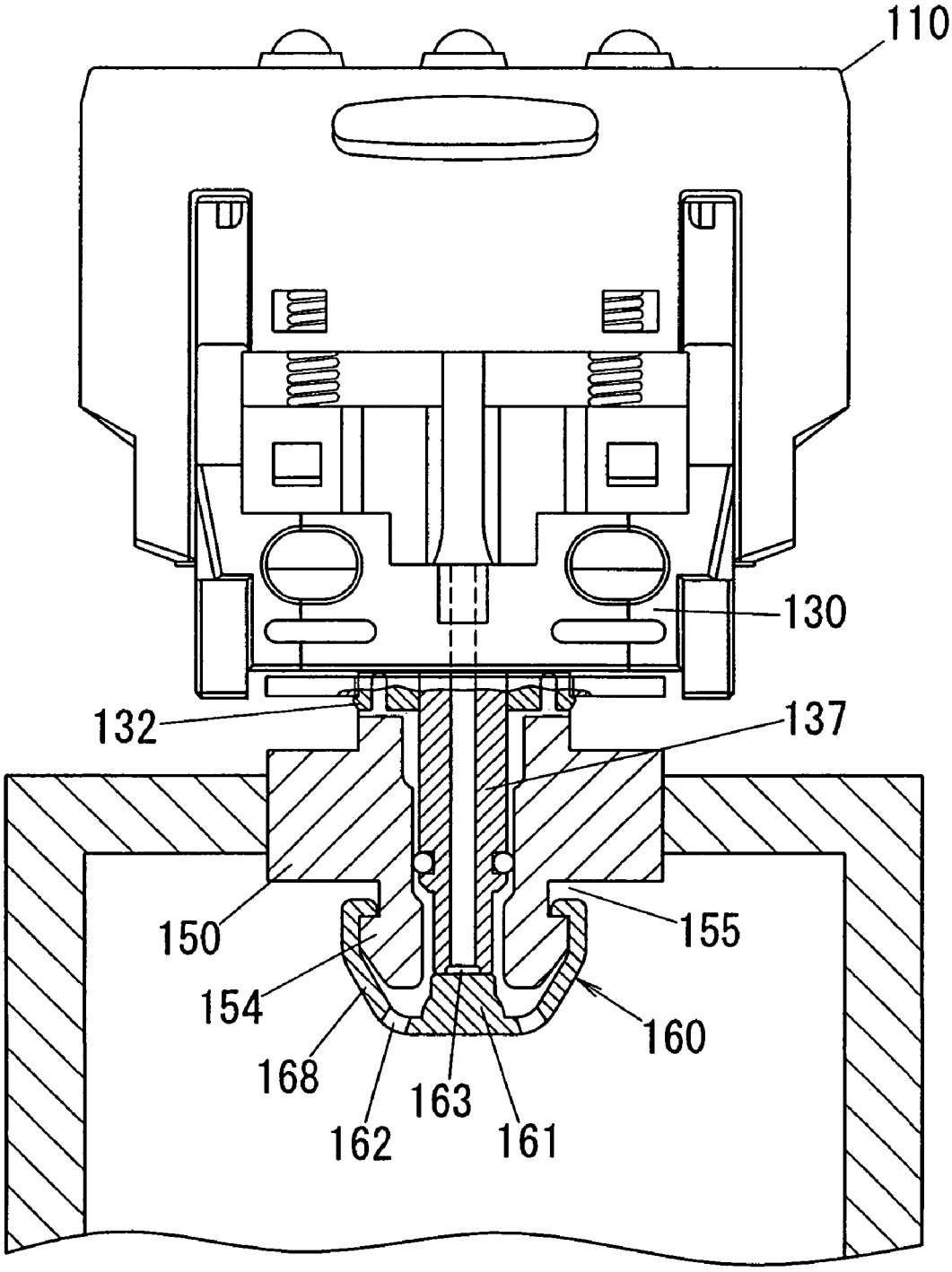
FIG. 23 is a vertical section showing the connection of the tank and the applicator.

Now referring to FIGS. 21 to 24, the tank 140, which is made of the flexible material into a collapsible bag having a reduced thickness relative to its width, is provided with a spout 150 detachable to the lotion feed path, i.e.,the plug tube 137 extending from the holder 130. The spout 150 is heat-sealed to the upper end of the tank 140 and has a socket hole 151 for selectively receiving the plug tube 137 and a cap 152. Projecting on the lower end of the spout 150 is a barrel 154 which carries a check valve 160 for allowing the lotion to be supplied to the applicator only when the plug tube 137 is inserted into the spout 150. As shown in FIG. 23, the holder 130 is provided on its lower end with a pair of hooks 132 which are detachably engaged with corresponding slots 153 in the upper end of the spout 150. When the holder 130 is coupled to the spout 150, the plug tube 137 extends through the socket hole 151 and pushes the check valve 160 to open it for allowing the lotion to be discharged through a gap between the valve 160 and the lower end of the plug tube 137.

Figure 24:
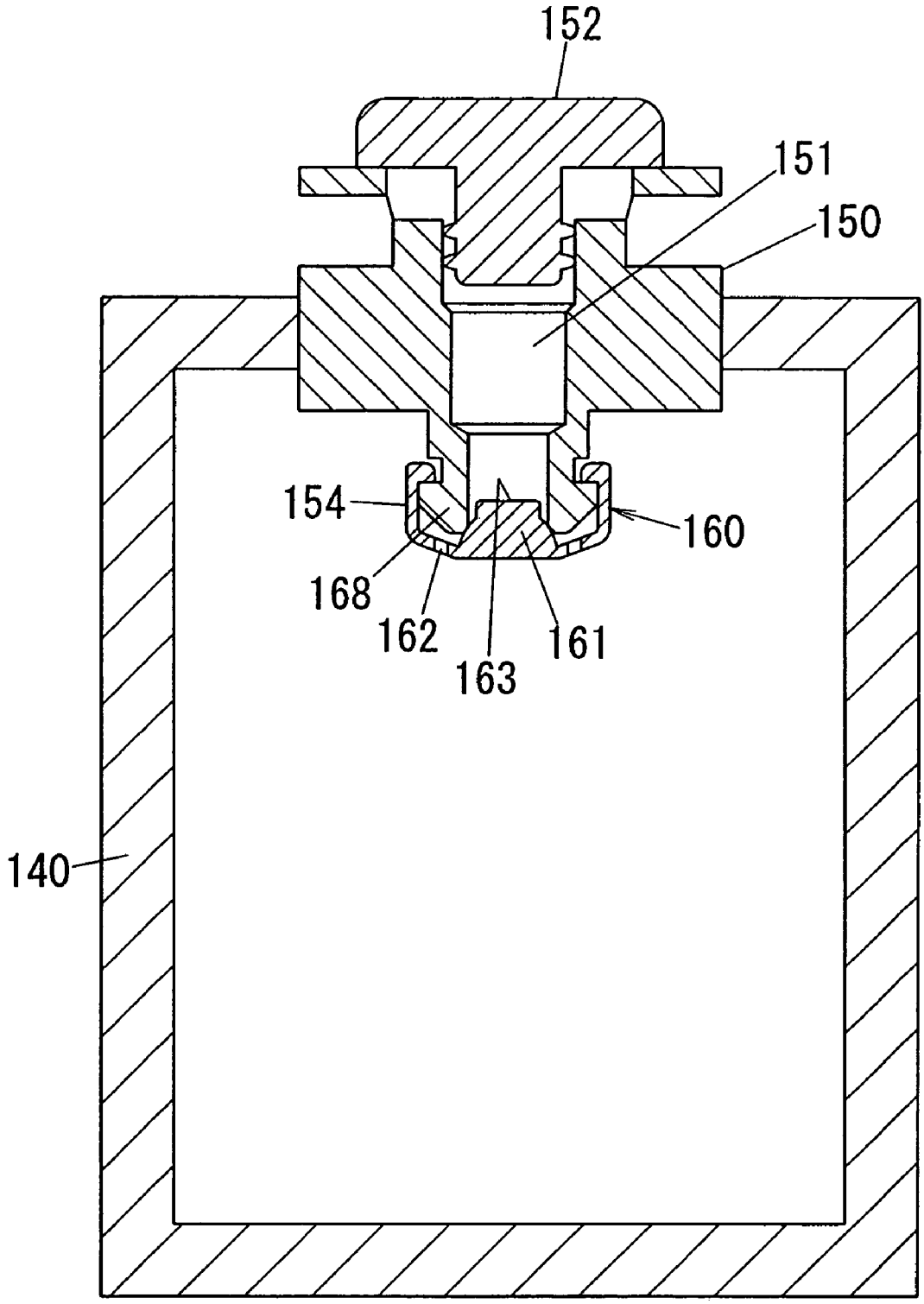
FIG. 24 is a vertical section of the tank.

The check valve 160 is made of a rubber in the form of a bottom-closed cylinder with a semi-spherical bulge 161 on the center of the bottom and a thin circular side wall 168 upstanding from a thin periphery of the bottom for engagement with a recess 155 in the barrel 154 of the spout 150. The check valve 160 is shaped into a thin structure other than at the semi-spherical bulge 161 to be given elastic deformability such that the semi-spherical bulge 161 has its rounded portion normally kept in sealing contact with the lower end of the barrel 154 for closing the spout, as shown in FIG. 24. When the plug tube 137 is inserted into the spout 150, the semi-spherical bulge 161 is pushed thereby to move away from the lower end of the barrel 154 for opening the spout, as shown in FIG. 23. The check valve 160 is formed in the bottom around the bulge 161 with apertures 162 for introducing the lotion from within the tank 140. The semi-spherical bulge 161 is formed at its apex with a cross-shaped seat projection 163 which is responsible for bearing the lower end of the plug tube 137 inserted into the socket hole 151 while leaving the gap therebetween for passing the lotion into the plug tube 137. The gap, which is left between the rounded portion of the semi-spherical bulge 161 and the lower end of the plug tube 137, ranges from 0.2 mm to 3 mm for smoothly passing the lotion therethrough. The valve 160 is preferably made of an elastic rubber selected at least one from the group consisting of ethylene-propylene rubber, nitrile-butadiene rubber, and fluorinated rubber. These materials exhibit less permeability to alcohol preferably contained in the lotion to prevent evaporation of the lotion from within the tank.

Figure 25:
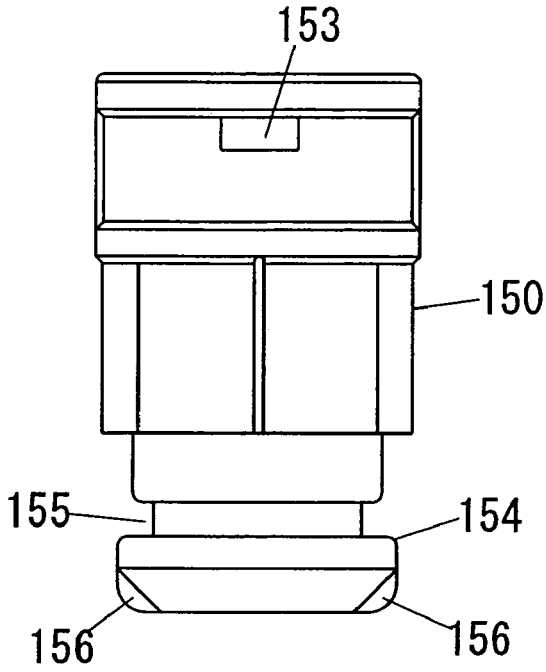
FIG. 25 is a side view of a spout of the tank.
Figure 26:
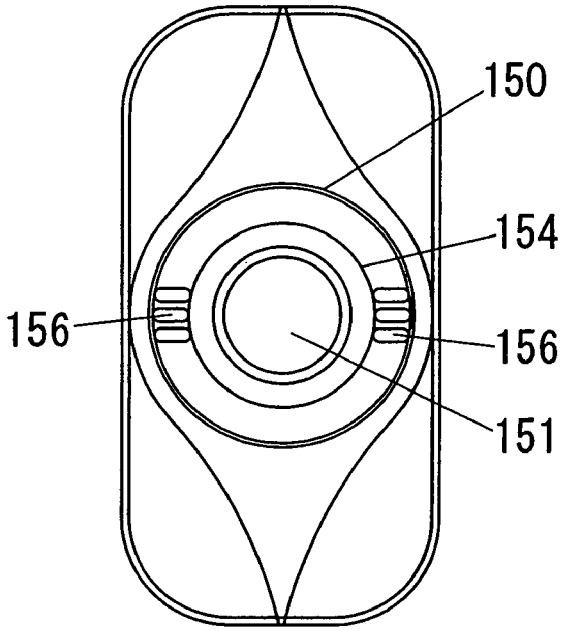
FIG. 26 is a bottom view of the above spout.
Figure 27:
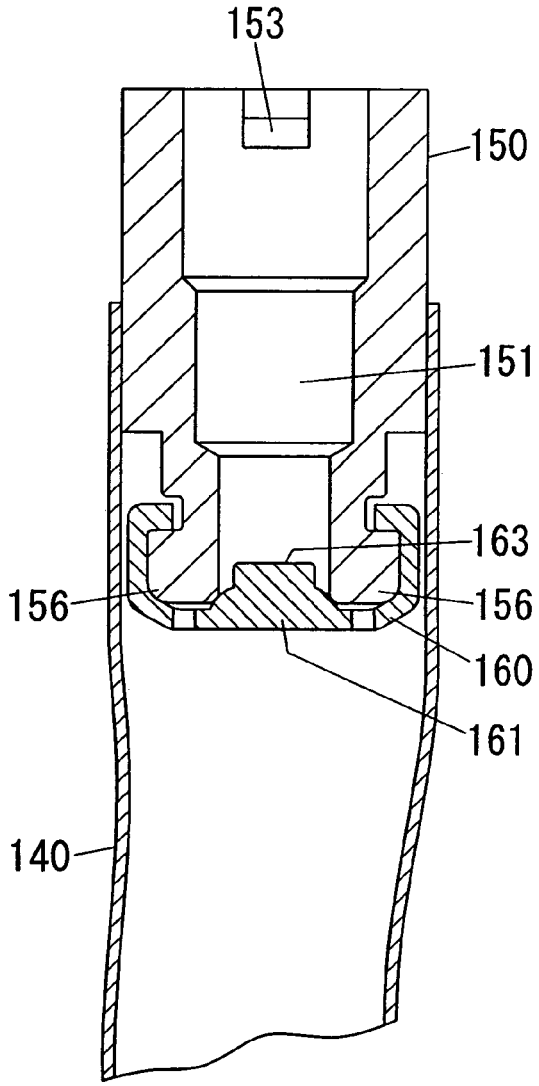
FIG. 27 is a vertical side section of the tank.
Figure 28:
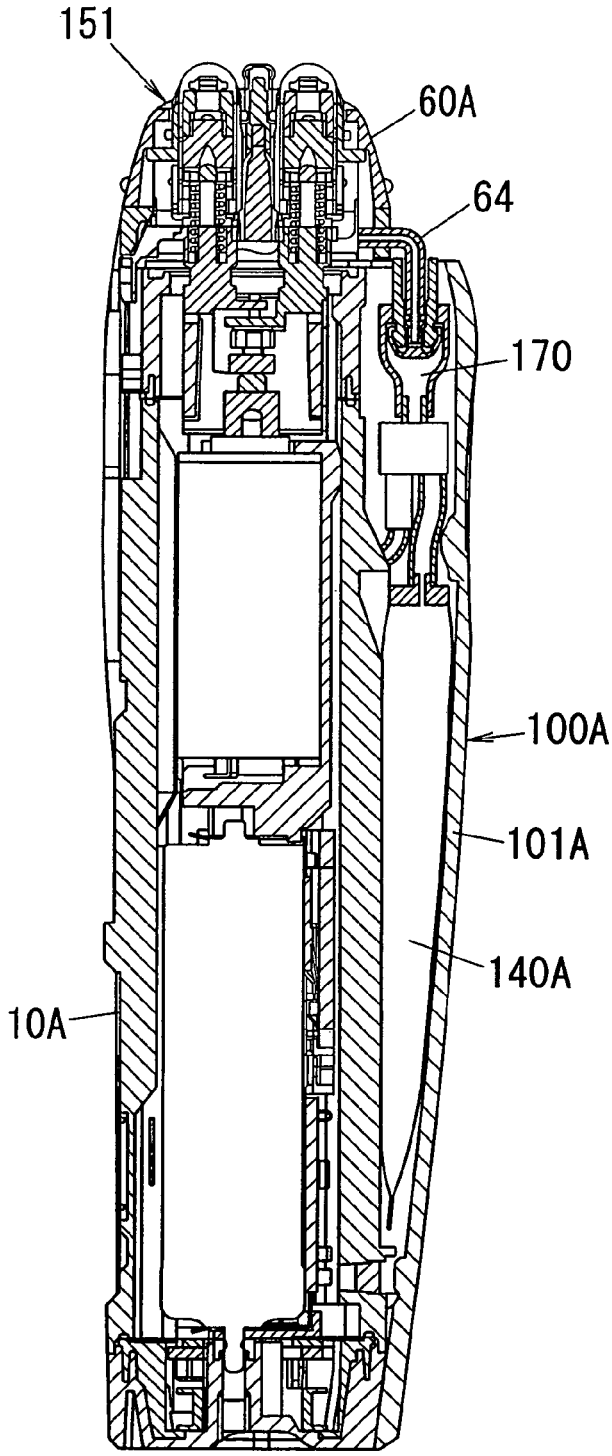
FIG. 28 is a vertical section of a device in accordance with a seventh embodiment of the present invention.
Figure 29:
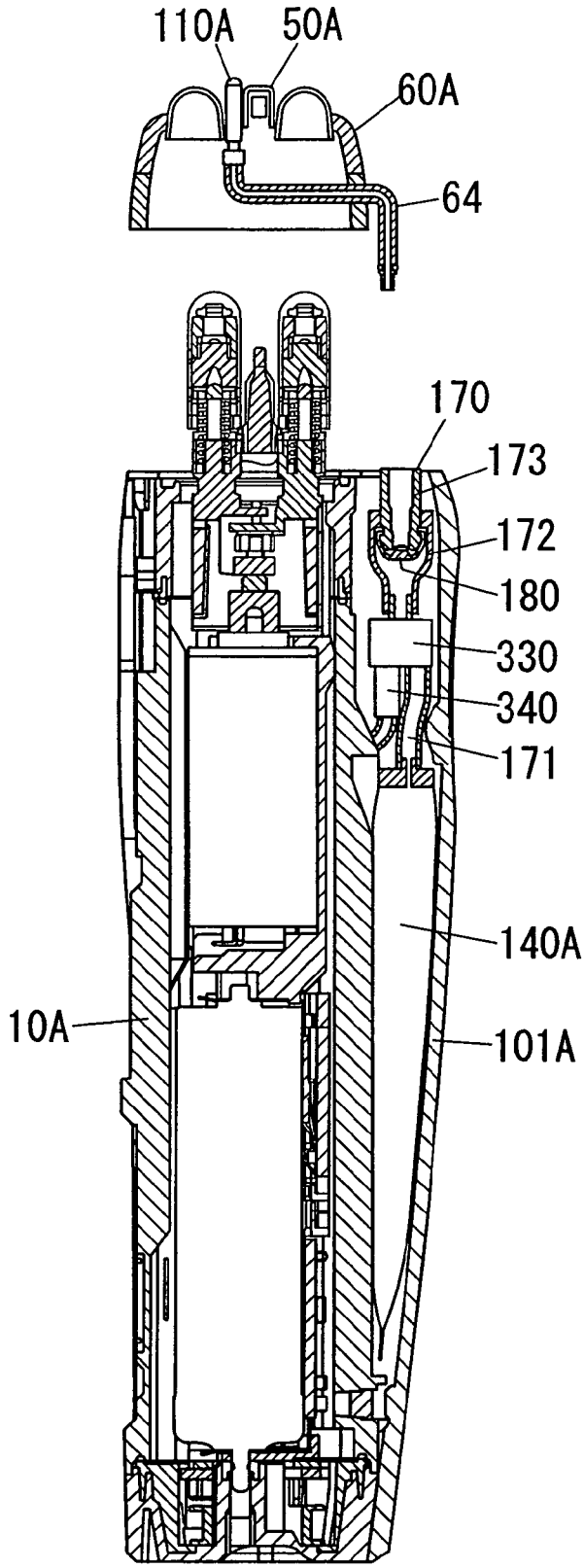
FIG. 29 is an exploded vertical section of the above device.
Figure 30:
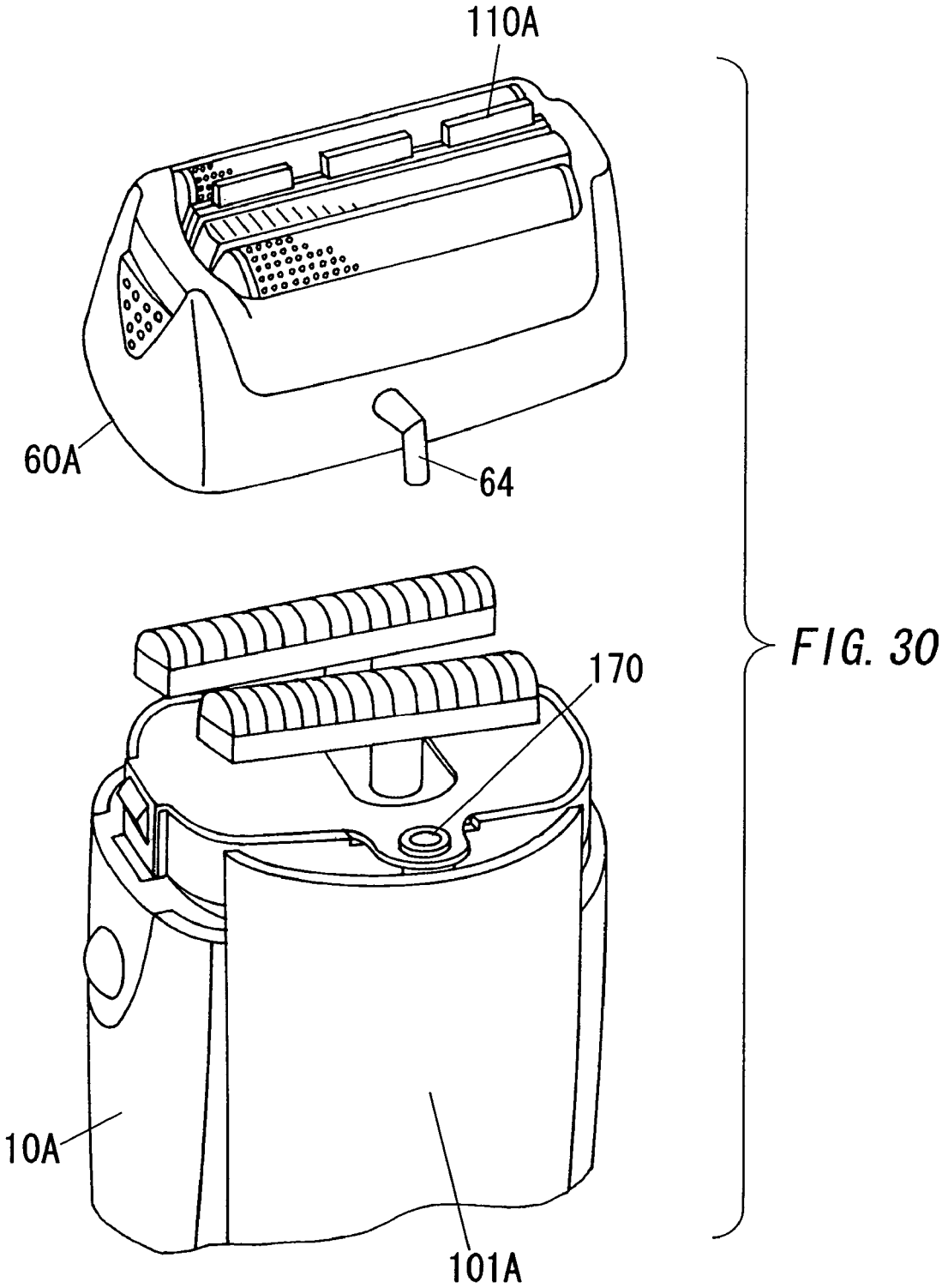
FIG. 30 is an exploded perspective view of the above device.

As shown in FIGS. 25 to 27, the barrel 154 is formed at its lower end circumference with a pair of restrictors 156 in the form of projections for preventing accidental deformation of the valve 160 leading to unintended opening. The restrictors 156 are provided at diametrically opposed portions in alignment with the thickness direction of the tank 140 so as to back-up the thin side wall 168 of the valve 160 for preventing an external force from applying to the side wall, as shown in FIG. 27. The external force is likely to be applied in the thickness direction of the tank 140 while the user holds the tank 140 of thin configuration. The lower end of the barrel other than the restrictors 156 are inclined for facilitating the side wall 168 of the valve 160 to give sufficient elastic deformation to the valve for closing and opening the end of the barrel 154.

Seventh Embodiment <FIGS. 28 to 35>

Figure 31:
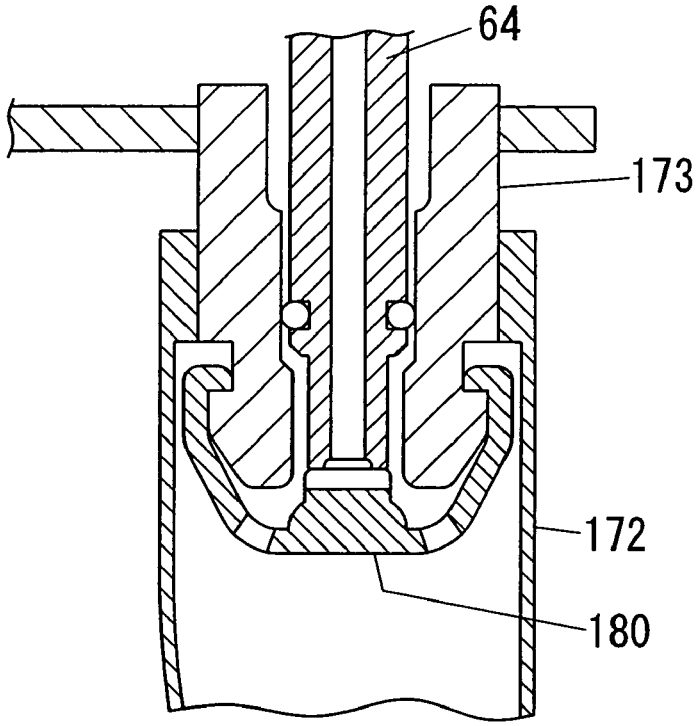
FIGS. 31 and 32 are vertical sections showing a lotion feed path connection of the device, respectively.
Figure 32:
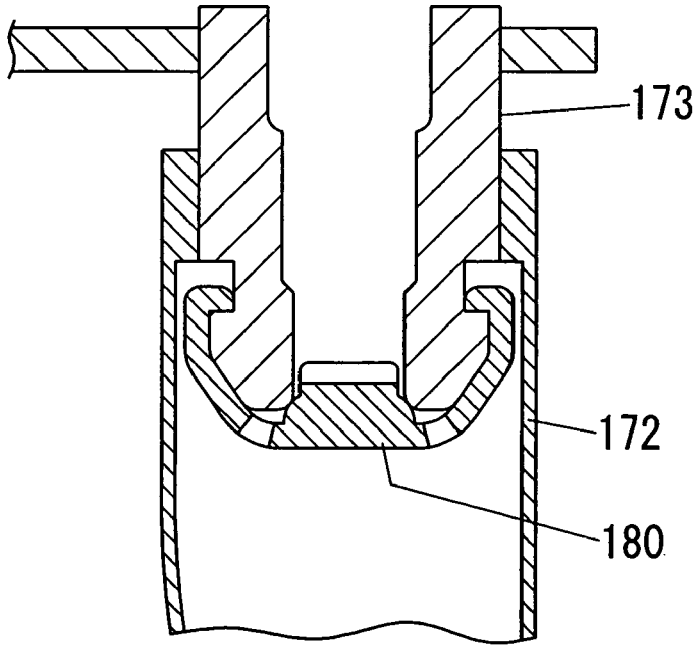

FIGS. 28 to 35 illustrate a seventh embodiment of the present invention which is basically identical to the first embodiment except that an applicator 110A is incorporated into a hair removing head 30A and is detachable together with a head frame 60A from a housing 10A. The other structures and operations are identical to the first embodiment. Therefore, no duplicate explanation is made herein and like parts are designated by like reference numerals with a suffix letter of "A". The applicator 110A is mounted on the head frame 60A to be located adjacent the long-hair cutter 50A. The head frame 60A carries a head conduit 64 extending integrally from the applicator 110A and projecting outwardly of the head frame 60A for detachable connection with a tank conduit 170 which extends from the tank 140A and is mounted on the side of the lotion feed module 100A attached to the housing 10A. A diaphragm pump 330 is provided in the course of the tank conduit 170 to draw the lotion from within the tank 140A. The lotion feed module 100A includes the front cover 101A and a motor 340 for the diaphragm pump 330 in addition to the tank conduit 170. In this embodiment, the lotion supply mechanism includes the pump 330, and the lotion feed path defined by the tank conduit 170 and the head conduit 64. The tank conduit 170 is composed of a pump inlet tube 171 connecting the tank 140A to the pump 330, a pump outlet tube 172 extending from the pump, and a coupling tube 173 integrally extending from the pump outlet tube 172 for detachable connection with the head conduit 64. The coupling tube 173 is provided at its lower end away from the connection to the head conduit 64 with a check valve 180 which is identical to the check valve 160 utilized in the spout 150 of the tank 140 as explained in detail with reference to FIGS. 22 to 27. That is, the check valve 180 is caused to open the lotion feed path upon the head conduit 64 being inserted into the coupling tube 173 for feeding the lotion to the applicator 110A, as shown in FIG. 31. Otherwise, the coupling tube 173, i.e., the tank conduit 170 is kept closed for preventing the lotion leaking from the tank 140 after the applicator 110A is detached from the housing 10A together with the head frame 60A, as shown in FIG. 32.

Figure 33:
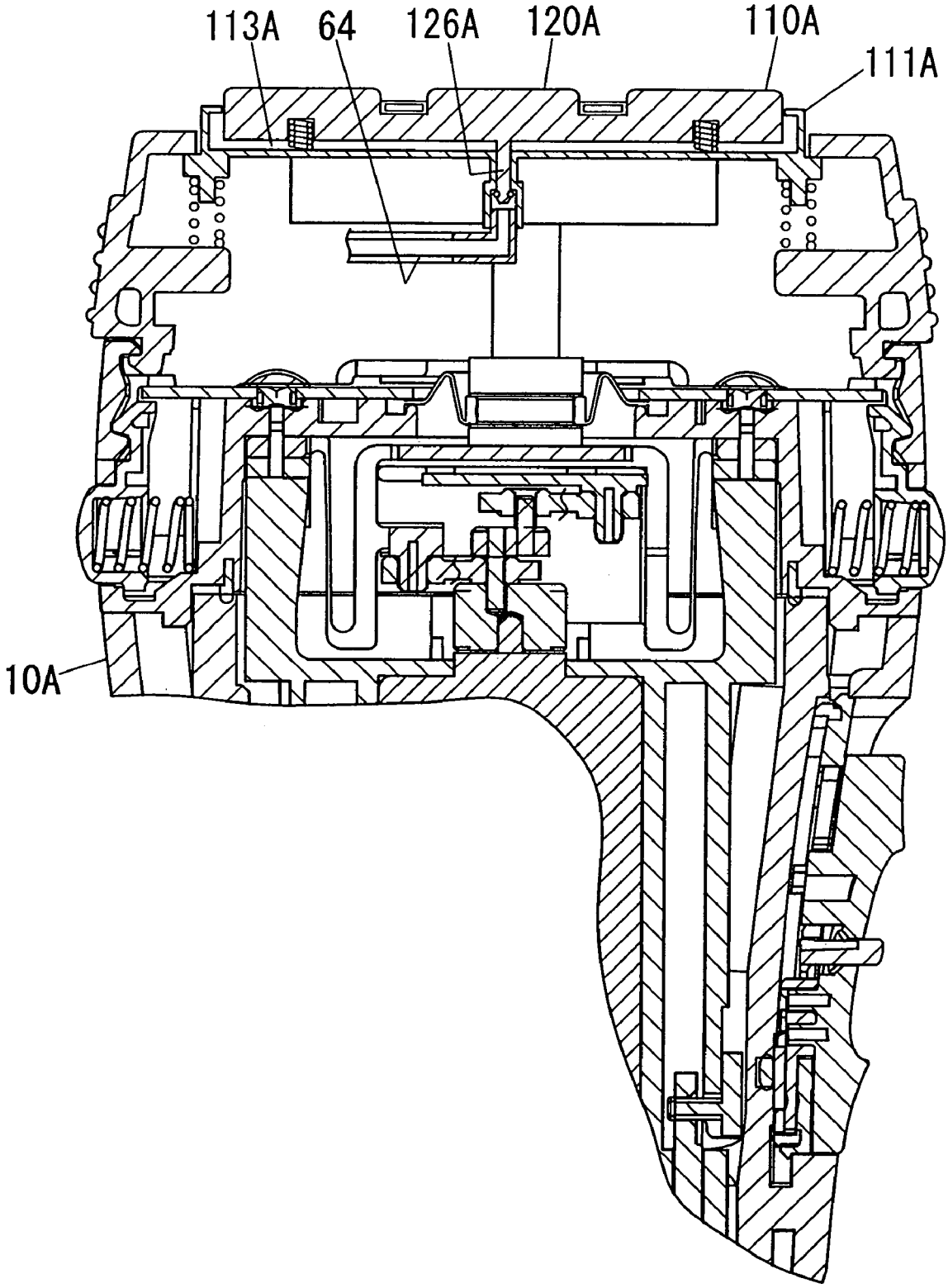
FIG. 33 is a vertical section of a hair removing head of the above device.
Figure 34:
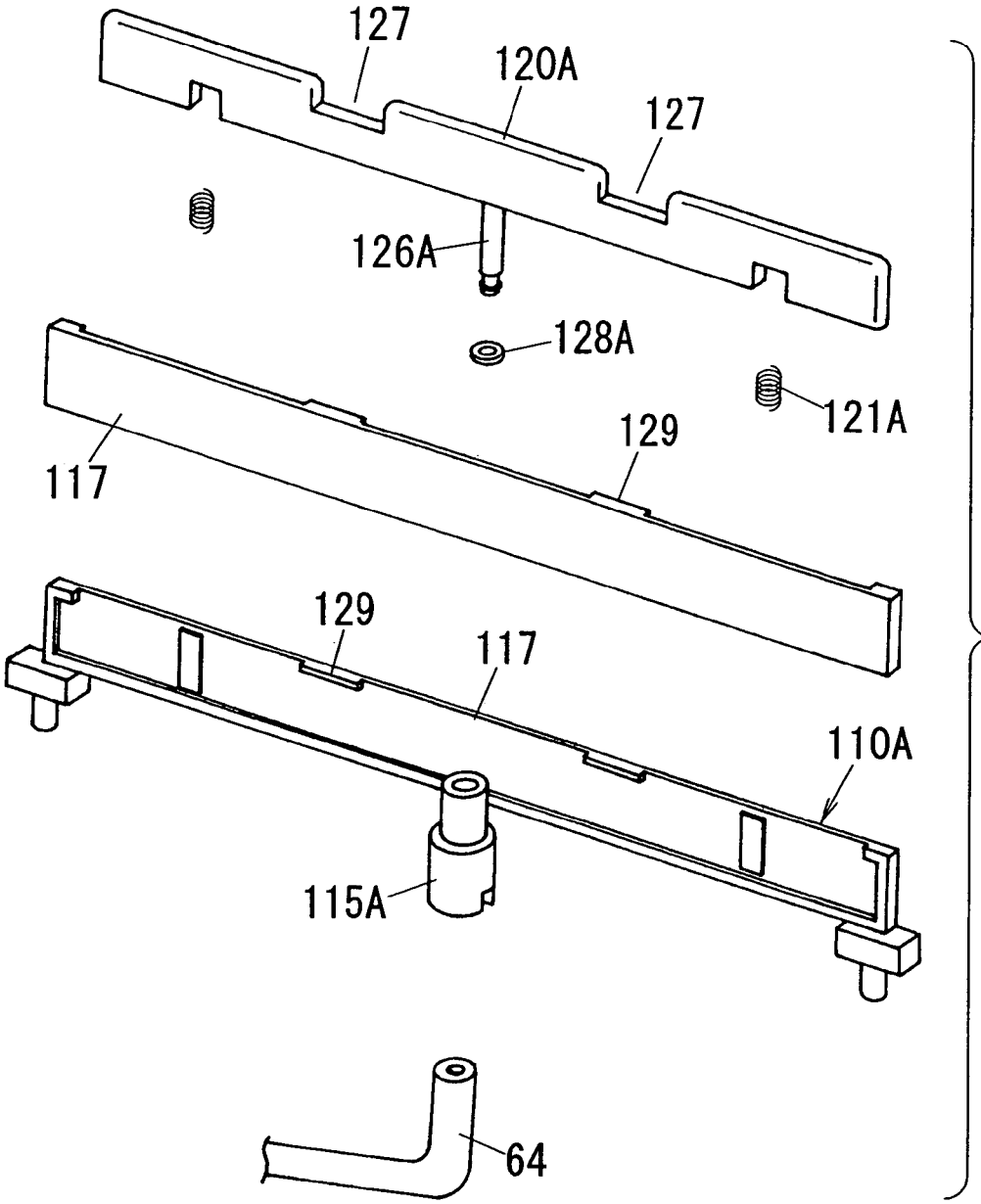
FIG. 34 is an exploded perspective view of an applicator of the above device.

As shown in FIGS. 33 and 34, the applicator 110A of the present embodiment comprises a skin guide 120A as one modification of the floating bed 120 depicted in the first embodiment. The skin guide 120A is made of an elastic material and has its top end projecting on top of the header 111 A for contact with the user's skin and has its bottom spaced from the bottom of the header 111A to define therebetween a like chamber 113A for temporarily storing the lotion supplied from the tank. The skin guide 120A is vertically movable between a pair of plates 117 forming the header 111A, and is urged upwardly by means of springs 121A. Lotion dispensing gaps are defined between recesses 127 in the skin guide and corresponding stops 129 at the upper end of the header 111A and are caused to open for dispensing the lotion as the skin guide 120A is depressed.

The header 111A has a sleeve 115A for connection with the head conduit 64 to be supplied with the lotion. A stem 126A, which projects from the lower end of the skin guide 120A and extends into the sleeve 115A, is formed at its lower end with a stop 128A which normally closes the sleeve 115A and opens as the skin guide 120A is depressed. Thus, the lotion is dispensed only when the skin guide 120A is pressed against the user's skin.

Figure 35A:
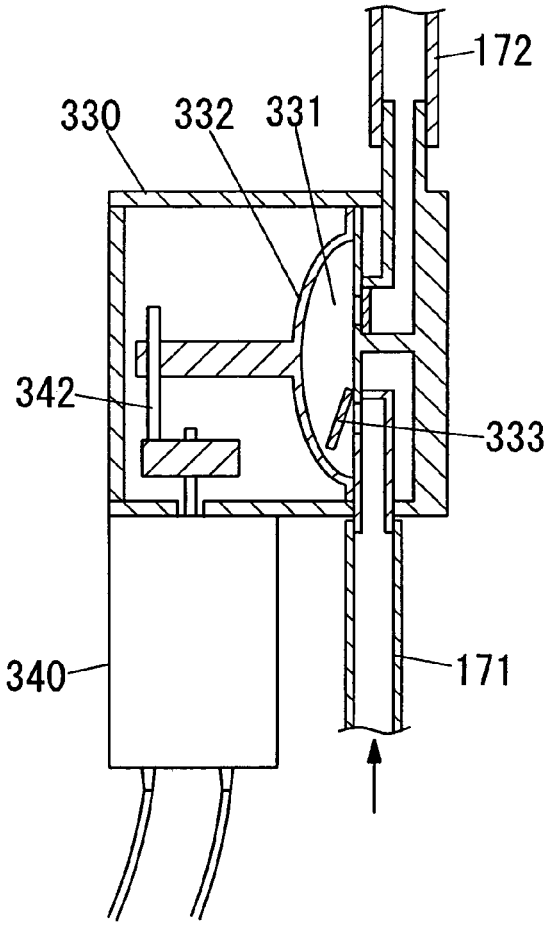
FIGS. 35A and 35B are diagrams showing the operation of a diaphragm pump utilized in the above device.
Figure 35B:
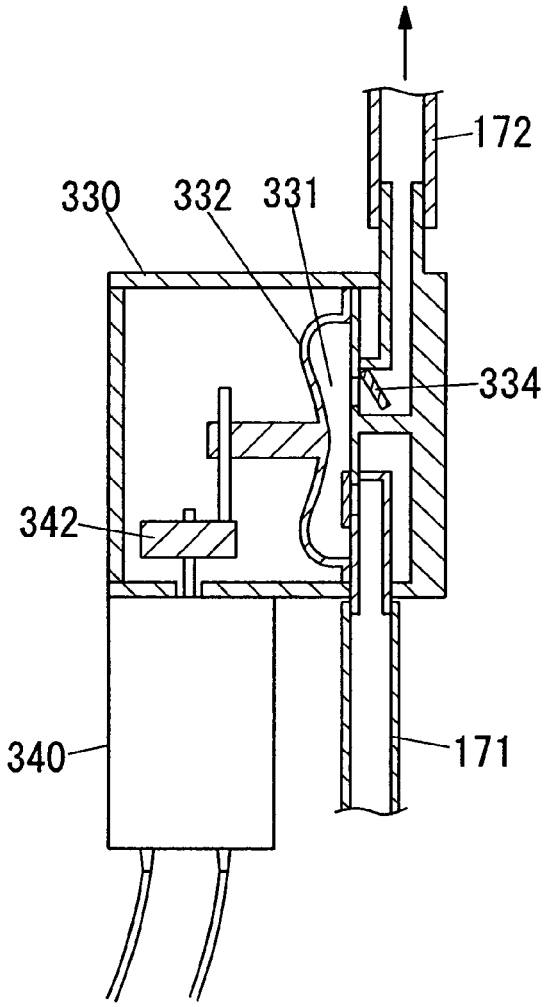

As shown in FIGS. 35A and 35B, the diaphragm pump 330 has a pump chamber 331 with a diaphragm 332 which is driven by the motor 340 to vary the volume of the chamber, thereby drawing the lotion through an inlet valve 333 in the chamber 331 and expelling the lotion through an outlet valve 334 to the applicator. For this purpose, a cam and crank combination 342 is provided for translating the rotational movement of the motor into a reciprocating movement of the diaphragm 332. A controller with an adjuster handle (not shown) is provided for controlling the rotational speed of the motor 340 so that the user can regulate the dispensing amount of the lotion from the applicator as is made in the previous embodiment. Thus, the controller and the motor constitutes the regulating means for regulation of the dispensing amount of the lotion. Further, the adjustor has a stop position of ceasing the pump to disable the applicator from dispensing the lotion.

Figure 36:
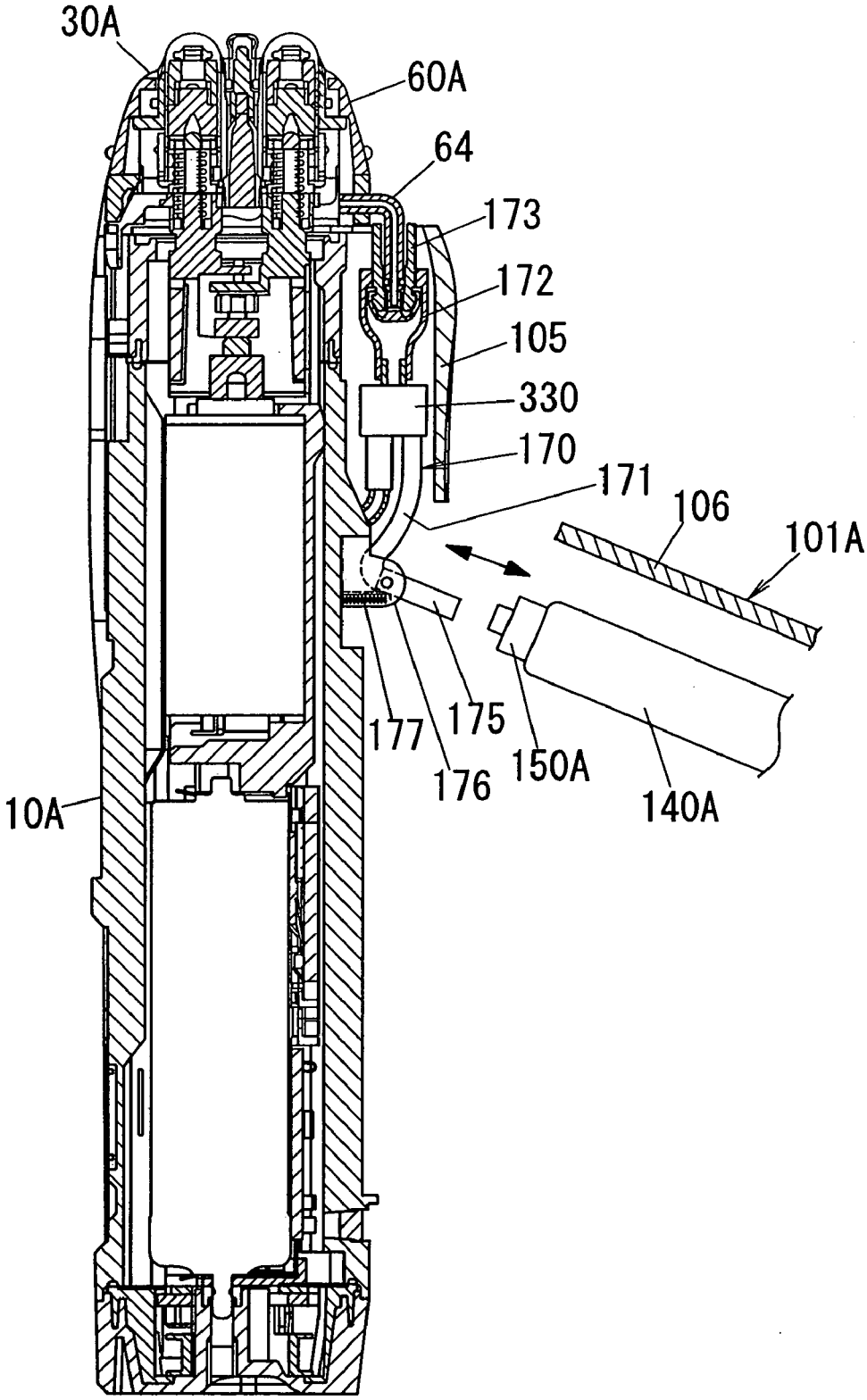
FIGS. 36 and 37 are vertical sections of a device in accordance with an eighth embodiment of the present invention.
Figure 37:
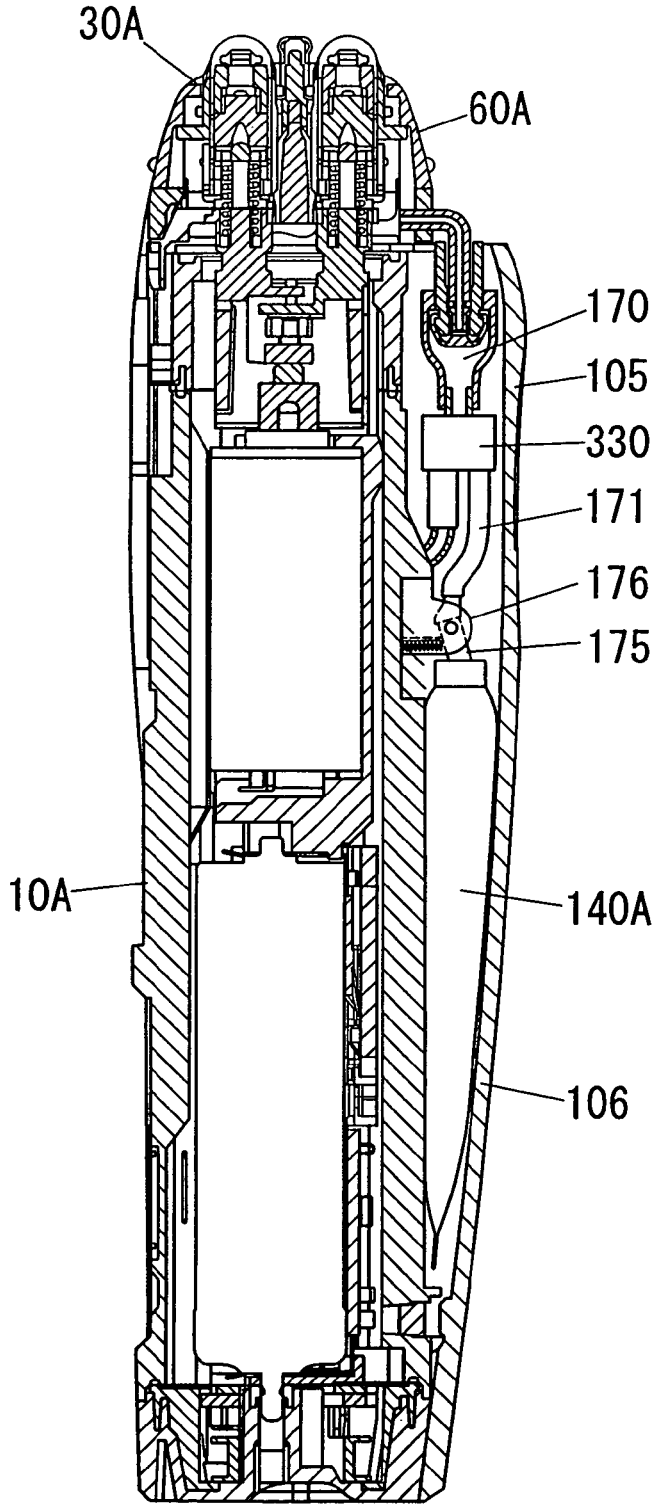

Eighth Embodiment <FIGS. 36 and 37>

FIGS. 36 and 37 illustrate an eighth embodiment of the present invention which is similar to the seventh embodiment except that the tank conduit 170 is configured to have its one end capable of being pivoted for facilitating the attachment and detachment of the tank to the tank conduit. The other structures and operations are identical to the seventh embodiment. Therefore, no duplicate explanation is made herein and like parts are designated by like reference numerals. The pump inlet tube 171, a part of the tank conduit 170, is additionally provided with a tank plug 175 for detachable insertion into the spout 150A of the tank 140A. The tank plug 175 has its one end connected to the pump inlet tube 171 and also pivotally supported to a bracket 176 on the housing 10A so that the tank plug 175 can be angled relative to a plane of the housing 10A. The bracket 176 includes a spring 177 for urging the tank plug 175 to project at a large angle with respect to the plane of the housing 10A, as shown in FIG. 36. In this connection, the front cover 101A is divided into an upper cover 105 and a lower cover 106 detachable to the upper cover 105. The upper cover 105 is secured to the housing 10A to conceal therebehind the pump 330 and the major portion of the tank conduit 170, while the lower cover 106 is detachable to the housing 10A to conceal therebehind the tank 140A. When the lower cover 106 is detached from the housing 10A for replacement of the tank 140A, the tank plug 175 pops up to project at the large angle relative to the plane of the housing 10A. Whereby, the tank can be easy to be connected to or disconnected from the tank plug 175, as shown in FIG. 36. The tank plug 175 after being connected to the tank 140 is folded on the housing 10A against the spring bias as a consequence of that the lower cover 106 is attached to the housing 10A to hold the tank therebetween, as shown in FIG. 37.

Figure 38:
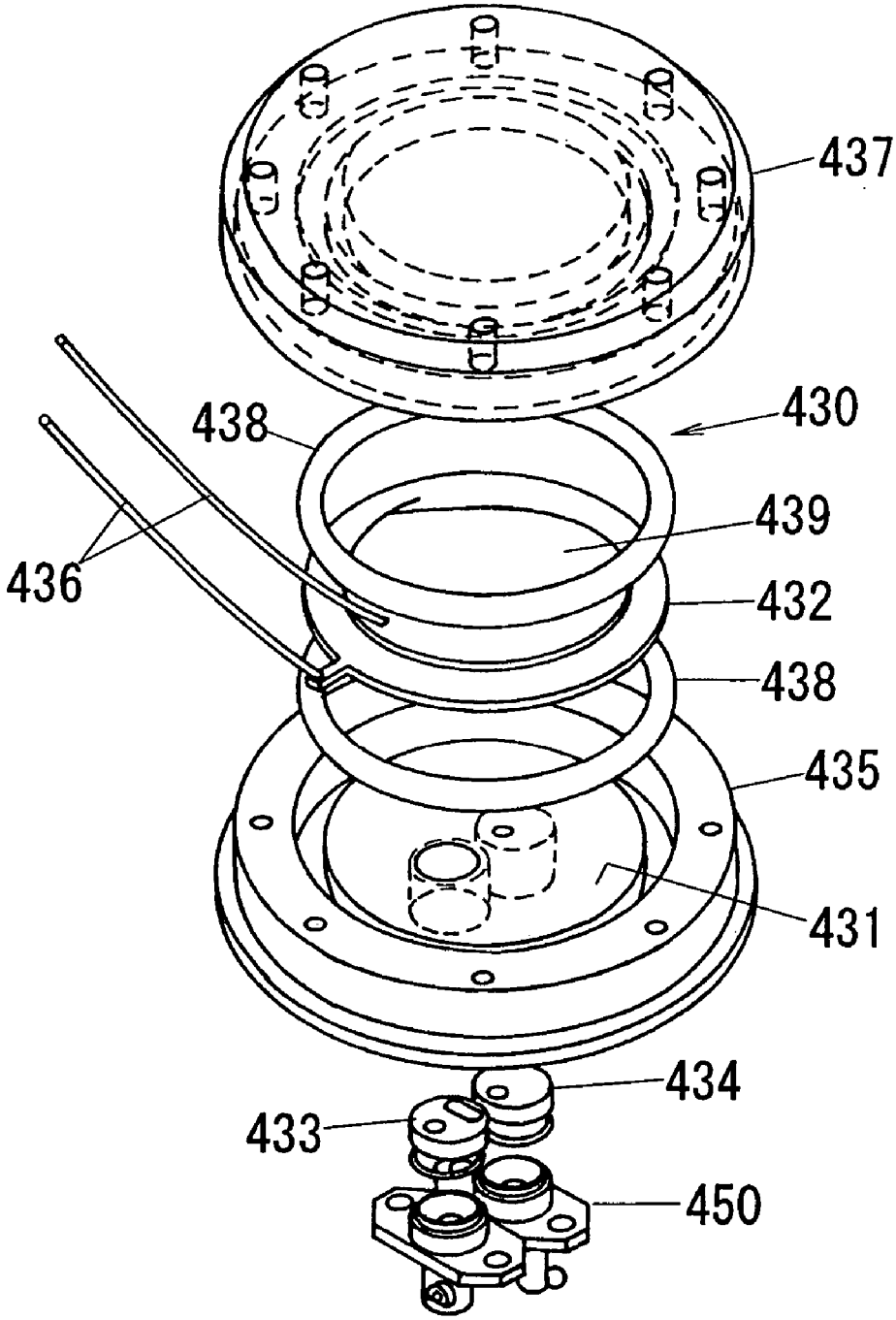
FIG. 38 is an exploded perspective view of a diaphragm pump utilized in a modification of the above device.
Figure 39:
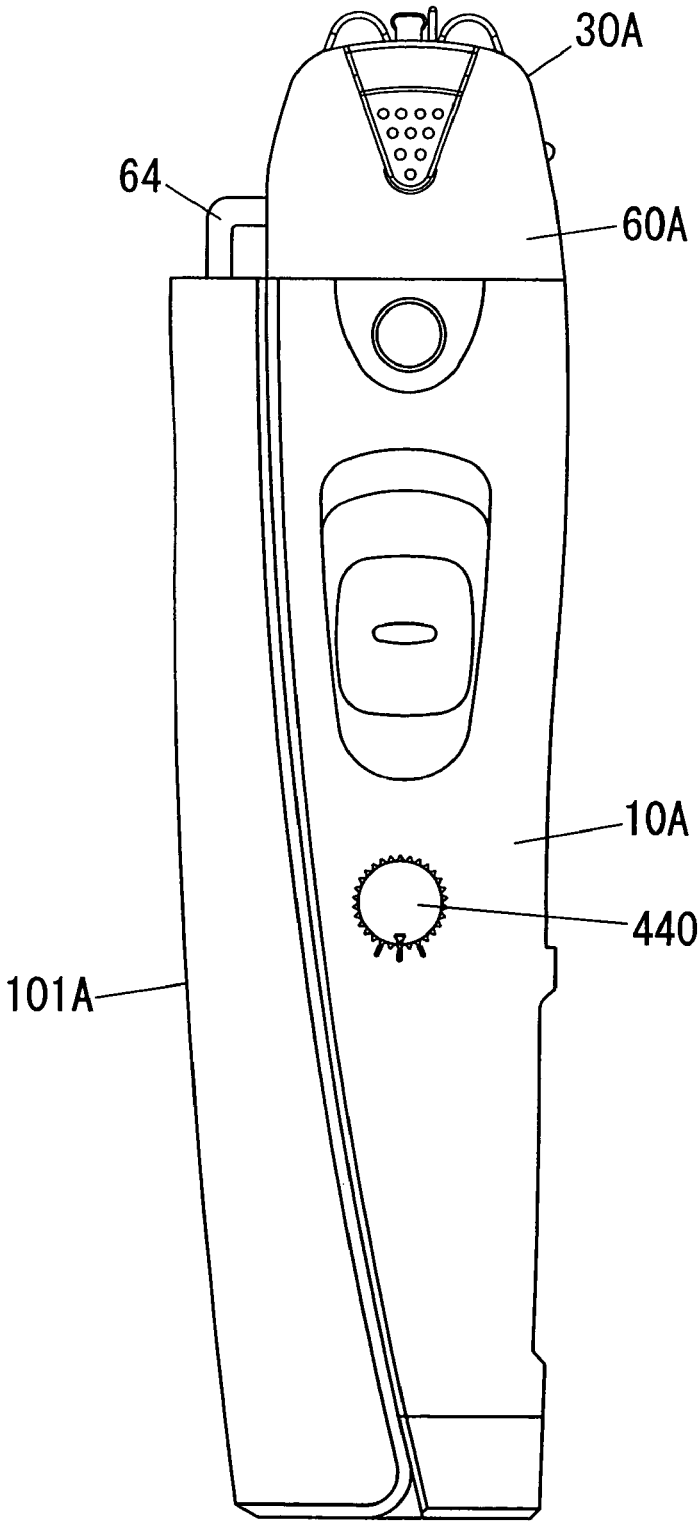
FIG. 39 is a side view of the above device.

FIG. 38 illustrates another diaphragm pump 430 which may be utilized in the present embodiment. The pump is actuated by a piezoelectric actuator 439 in the form of a film or disk incorporated in a diaphragm 432 and receiving a driving voltage from a control circuit through lines 436. The diaphragm 432 is placed on a pump case 435 to define therebetween a pump chamber 431. A cover 437 is secured on the pump case 435 to hold the circumference of the diaphragm 432 between the cover 437 and the pump case with the use of sealing rings 438. Attached to the bottom of the pump case 435 is a valve assembly 450 which includes an inlet valve 433 for drawing in the lotion from the tank and an outlet valve 434 for expelling the lotion to the applicator. As shown in FIG.39, the housing 10A is provided on its side with a handle 440 which actuates the control circuit to apply the voltage at varying frequencies for regulating the flow rate of the lotion or the amount of the lotion being discharged from the pump. Thus, the control circuit with the handle defines a regulating means for regulating the dispensing amount of the lotion, so that user can adjust the dispensing amount of the lotion from the applicator. Also, the handle 440 has a stop position of ceasing the pump to disable the applicator from dispensing the lotion.

Figure 40:
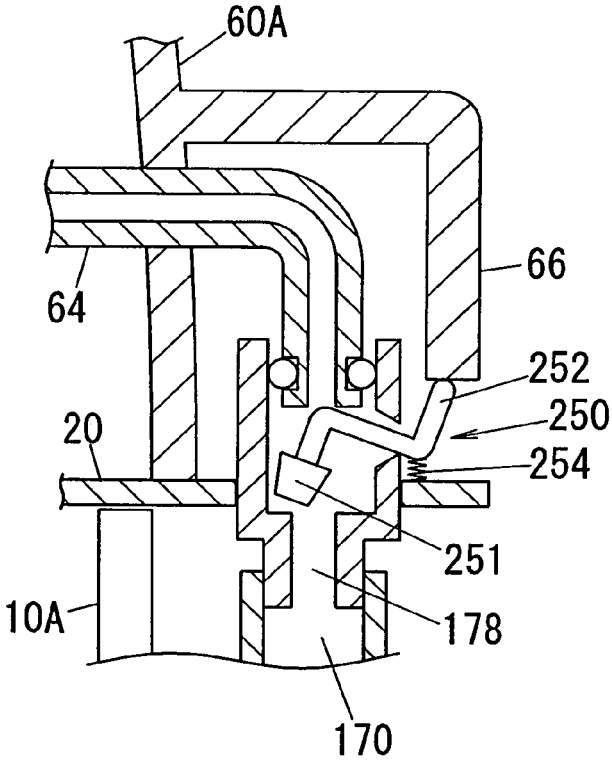
FIGS. 40 and 41 are diagrams showing a lotion feed path connection of a device in accordance with a ninth embodiment of the present invention, respectively.
Figure 41:
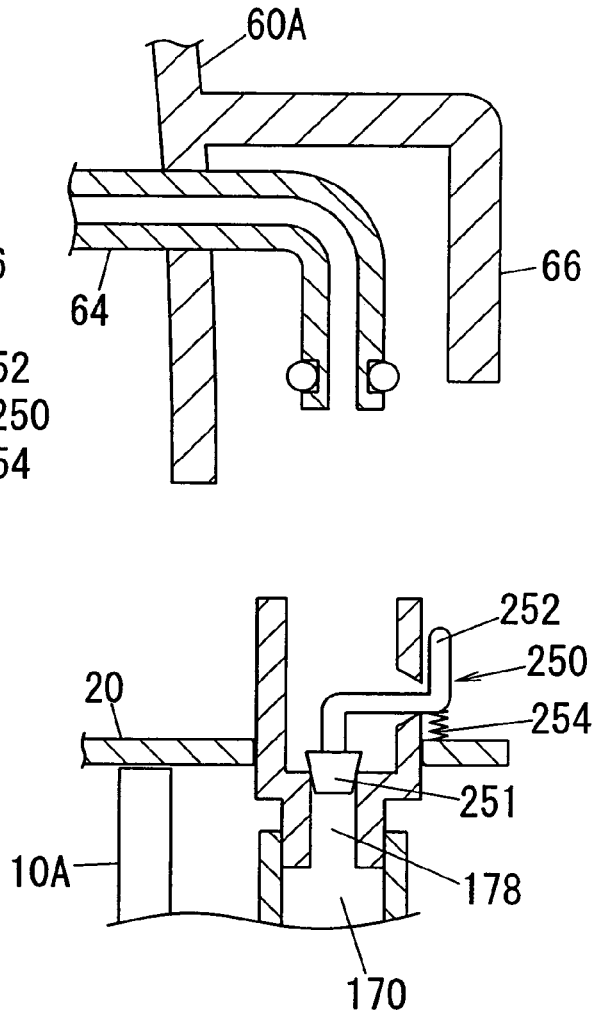

Ninth Embodiment <FIGS. 40 and 41>

FIGS. 40 and 41 illustrate a ninth embodiment of the present invention which is similar to the seventh embodiment except that a lock member 250 is introduced instead of the check valve 180 to stop the leakage of the lotion from the tank conduit 170 upon detachment of the applicator. The other structures and operations are identical to the seventh embodiment. Therefore, like parts are designated by like reference numerals. The lock member 250 is pivotally supported to a mounting plate 20 which is fixed to the housing 10A and through which the upper end of the tank conduit 170 extends for detachable connection with the head conduit 64. The lock member 250 is formed at its one end with a stop valve 251 which extends into the tank conduit 170 for closing and opening a constricted passage 178. The other end of the lock member 250 defines an actuator 252 which is engageable with a limb 66 integrally extending from the head frame 60A. The lock member 250 is urged by a spring 254 to pivot in a direction of closing the passage 178 by the stop valve 251. While the head frame 60A is attached to the housing 10A to mount the applicator thereon, the limb 66 pushes the actuator 252 so as to pivot the lock member 250 in a direction of opening the passage 178, as shown in FIG. 40, thereby allowing the lotion to be supplied to the applicator. Upon detachment of the head frame 60A from the housing 10A, on the other hand, the lock member 250 is released and is caused by the spring 254 to move the stop valve 251 for closing the passage 178. Thus, the lotion can be prevented from leaking out of the tank each time the head frame 60A is detached together with the applicator.

Figure 42:
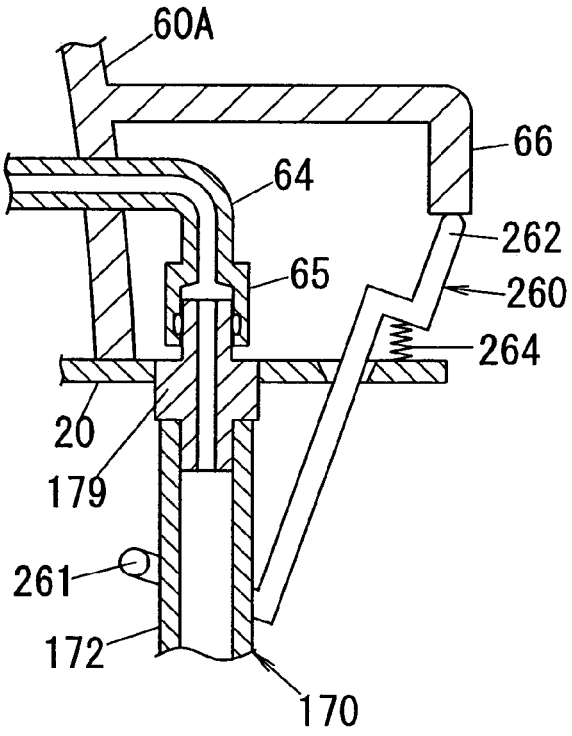
FIGS. 42 and 43 are diagrams showing a lotion feed path connection of a device in accordance with a tenth embodiment of the present invention, respectively.
Figure 43:
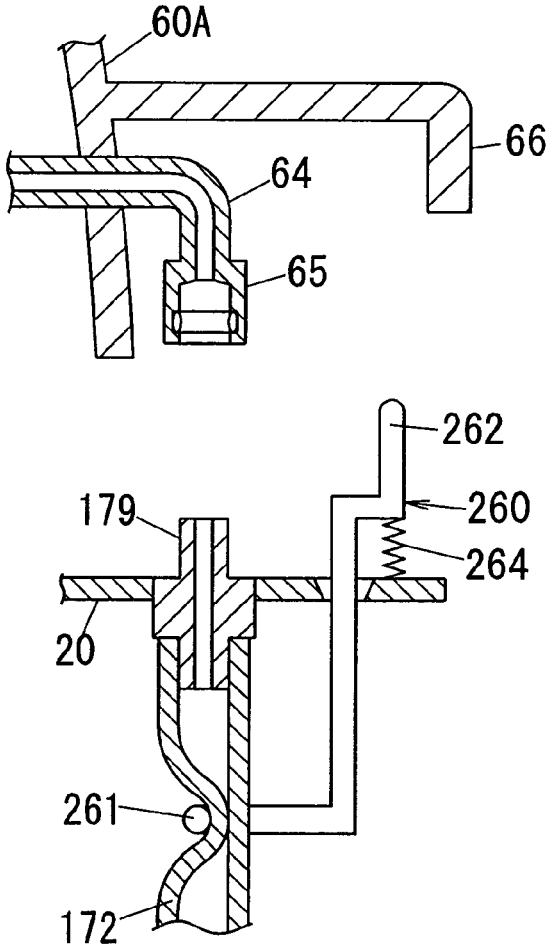

Tenth Embodiment <FIGS. 42 and 43>

FIGS. 42 and 43 illustrate a tenth embodiment of the present invention which is similar to the ninth embodiment except that a lock member 260 acts to deform a pump outlet tube 172 made of a flexible material to define a part of the tank conduit 170. The other structures and operations are identical to the seventh embodiment. Therefore, like parts are designated by like reference numerals. The pump outlet tube 172 is provided at its upper end with a ferrule 179 which is fixed to the mounting plate 20 for detachably connection to the head conduit 64 extending from the applicator. The lock member 260 is pivotally supported to the mounting plate 20 to be movable between a close position of closing the tank conduit 170 and an open condition of opening the tank conduit. For this purpose, the lock member 260 is formed at its end with a hook 261 engageable with the pump outlet tube 172, and is urged by a spring 264 to the close position. The other end of the lock member 260 defines an actuator 262 which is engageable with the limb 66 of the head frame 60A for interlocking the lock member 260 with the head frame 60A. While the head frame 60A is attached together with the applicator to the housing, the limb 66 pushes the actuator 252 to thereby pivot the lock member 260 into the open position where the hook 261 disengages from the pump outlet tube 172 to keep the lotion feed path open, as shown in FIG. 42. Upon detachment of the head frame 60A, on the other hand, the actuator 262 is released so that the lock member 260 returns to the close position where the hook 261 forcibly squeezes the pump outlet tube 172 to close the lotion feed path, as shown in FIG. 43. Thus, it is equally possible to shut the tank conduit 170 in response to the detachment of the head frame 60A from the housing for successfully preventing the leakage of the lotion from the tank conduit.

It is noted in this connection that the head conduit 64 is formed with a socket 65 which receives the upper end of the ferrule 179 for detachable connection therebetween. The socket 65 is located to have its socket hole facing downwards so as not to collect the clipped hairs dropping from the hear removing head upon detachment of the head frame 60A from the housing.

Further, the above lotion leakage prevention scheme by use of the lock members 250 or 260 is illustrated as related to the seventh embodiment in which the diaphragm pump 330 is responsible for feeding the pressurized lotion from the tank 140A through the tank conduit 170 to the applicator 110A. However, the lotion leakage prevention scheme may be equally utilized in the first embodiment in which the pressurizer 70 is responsible for feeding the pressurized lotion to the applicator.

Figure 44:
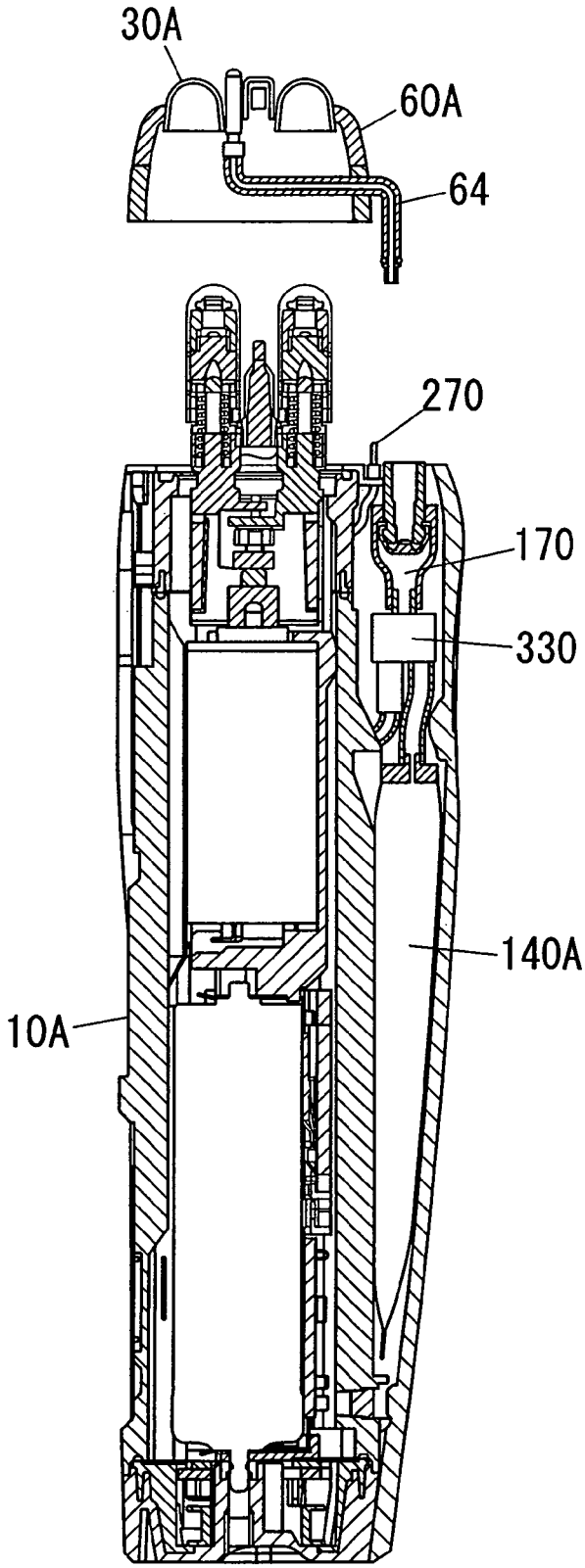
FIG. 44 is a vertical section of a device in accordance with an eleventh embodiment of the present invention.

Eleventh Embodiment <FIG. 44>

FIG. 44 illustrates an eleventh embodiment of the present invention which is similar to the seventh embodiment except that a switch 270 is provided to stop operating the diaphragm pump 330 in response to the detachment of the head frame 60A from the housing 10A. The other structures and operations are identical to the seventh embodiment. Therefore, like parts are designated by like reference numerals. The switch 270 is mounted on the housing 10A in an engageable relation with the head frame 60A and is actuated by the head frame attached to the housing in order to enable the pump 330 for feeding the pressurized lotion to the applicator. Upon removal of the head frame 60A, the switch 270 is released to disable the pump, thereby preventing the lotion from being discharged out of the tank conduit 170.

The hair removing device as illustrated with reference to the embodiments of FIGS. 28 to 44 only show the shaver head as one typical hair removing head, however, the features disclosed with reference to FIGS. 28 to 44 are also applicable to the hair removing device including the epilation head as shown in FIG. 13 or any other hair removing head.

The invention claimed is:

1. A hair removing device with a lotion applicator, said device comprising:

a housing;

a hair removing head mounted to said housing and adapted to be held against a user's skin for hair depilation or hair epilation, an applicator which dispenses a lotion on the user's skin;

a tank holding the lotion;

a lotion supply mechanism for supplying said lotion from said tank to said applicator, wherein said lotion supply mechanism includes a regulating means which regulates an amount of said lotion being dispensed from said applicator, said lotion supply mechanism includes a powered pump for expelling the lotion from said tank to said applicator, said regulating means including a handle for varying pump capacity of said powered pump, wherein said applicator is incorporated into a head frame forming a part of said hair removing head, said head frame being detachable from said housing, said lotion supply mechanism including a head conduit extending integrally from said applicator and a tank conduit extending from said tank, said tank conduit being detachably connected to said head conduit for feeding said lotion from said tank to said applicator, said head conduit being detachable together with said head frame from said housing, said lotion supply mechanism further including a stop means which, in response to the detachment of said head frame from said housing, stops feeding the lotion out of said tank conduit.

2. The device as set forth in claim 1, wherein said stop means is in the form of a check valve provided at one end of said tank conduit for closing the tank conduit, said check valve being actuated by said head conduit to open when said head conduit is connected to said tank conduit.

3. The device as set forth in claim 1, wherein said head conduit is connected to said tank conduit outside of said hair removing head.

4. A hair removing device with a lotion applicator, said device comprising:

a housing;

a hair removing head mounted to said housing and adapted to be held against a user's skin for hair depilation or hair epilation, an applicator which dispenses a lotion on the user's skin;

a tank holding the lotion;

a lotion supply mechanism for supplying said lotion from said tank to said applicator, wherein said applicator is incorporated into a head frame forming a part of said hair removing head, said head frame being detachable from said housing, said lotion supply mechanism including a head conduit extending integrally from said applicator and a tank conduit extending from said tank, said tank conduit being detachably connected to said head conduit for feeding said lotion from said tank to said applicator, said head conduit being detachable together with said head frame from said housing, said lotion supply mechanism further including a stop means which, in response to the detachment of said head frame from said housing, stops feeding the lotion out of said tank conduit.

* * * * *